US006351967B1

(12) United States Patent
Adachi et al.

(10) Patent No.: US 6,351,967 B1
(45) Date of Patent: Mar. 5, 2002

(54) REFRIGERATOR WITH A FREEZER COMPARTMENT

(75) Inventors: Takenori Adachi; Syunsuke Kojima; Yoshihiko Kojima; Katuyoshi Fujisawa; Takashi Ueno; Narumi Nakajima, all of Tokyo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/592,455

(22) Filed: Jun. 9, 2000

(30) Foreign Application Priority Data

Aug. 6, 1999 (JP) ..... 11-223644

(51) Int. Cl.[7] ..... F25D 11/02
(52) U.S. Cl. ..... 62/441; 62/407
(58) Field of Search ..... 62/440, 441, 408, 62/407

(56) References Cited

U.S. PATENT DOCUMENTS 6,055,826 A * 5/2000 Hiraoka et al. ..... 62/408

FOREIGN PATENT DOCUMENTS

JP 5-223431 8/1993

JP 2698569 9/1997

* cited by examiner

*Primary Examiner*—William Doerrler
*Assistant Examiner*—Melvin Jones
(74) *Attorney, Agent, or Firm*—Oblon, Spivak, McClelland, Maier & Neustadt, P.C.

(57) ABSTRACT

A middle volume of refrigerator includes a refrigerating compartment provided at an upper position therein; a freezer compartment provided at a lower position therein; and a new temperature zone of freezer compartment, the new temperature zone of freezer compartment working as a compartment having a new temperature zone of not higher than a maximum ice forming temperature zone and higher than a freezing temperature zone, wherein the new temperature zone of freezer occupies substantially an entire width of the refrigerator. The new temperature zone of freezer compartment may have a temperature therein set to a temperature that foods preserved in the new temperature zone of freezer compartment can be cut without being thawed. The new temperature zone of freezer compartment may be a compartment switchable to at least one of the freezing temperature zone, an ice forming temperature zone, a refrigerating temperature zone and a vegetable compartment temperature zone or a wine preserving temperature zone in addition to the new temperature zone.

17 Claims, 18 Drawing Sheets

*1 MAXIMUM ICE FORMING ZONE
*2 FREEZING TEMPERATURE ZONE

TEMPERATURE OF TUNA AND CUTTING LOAD

TEMPERATURE OF PORK AND CUTTING LOAD

FIG. 6

Acceptable storing terms (days) at different storing temperatures
(The underlined values indicate the minimum acceptable storing terms.)

| Article of food | Criteria | Storing temperature (°C) | | |
|---|---|---|---|---|
| | | Chilled compartment (0) | Partially freezing compartment (-3) | New temperature zone of compartment (-7) |
| For tuna sashimi (fresh slices of raw tuna) | Sensory evaluation ④<br>K value 20% | 4<br>4 | 6<br>10 | 14<br>30 |
| For tuna to be cooked | Sensory evaluation ③<br>K value 60%<br>Bacteria on surface $10^4$ | 6<br>24<br>18 | 10<br>Not less than 40<br>Not less than 40 | 24<br>Not less than 40<br>Not less than 40 |
| For ground meet to be cooked | Sensory evaluation ③<br>Numbers of living bacteria $10^6$ | 6<br>5 | 14<br>10 | 35<br>Not less than 40 |
| Broccoli (branched) | Sensory evaluation ③<br>Numbers of living bacteria $10^6$ | 12<br>25 | Not less than 35<br>Not less than 35 | Not less than 35<br>Not less than 35 |
| Meat source (reheated one stored in a can commercially available) | Sensory evaluation ③<br>Numbers of living bacteria $10^6$ | Not less than 35<br>Not less than 35 | Not less than 35<br>Not less than 35 | Not less than 35<br>Not less than 35 |

Sensory evaluation criteria: ⑤ absence of stench or discoloration, ④ presence of slight stench and slight discoloration, ③ eatable limit, ② presence of stench and discoloration, ① rotten

FIG. 7

Time that articles of food stored at -18°C take to become cuttable (time required for the temperatures of the articles to reach -6°C: minute)

| Thawing method / Articles of food | Refrigerating compartment | Room temperature | Microwave oven |
|---|---|---|---|
| Beefsteak (8×11×2 cm) | 50 | 18 | 1 |
| Mixture of ground beef and ground pork (8×11×2 cm) | 66 | 23 | 1 |
| Tuna (6×11×2 cm) | 52 | 21 | 1 |

FIG. 8

Surface temperature of articles of food when having been thawed in a microwave oven

| Surface temperature of article (°C) | minimum | maximum |
|---|---|---|
| -7°C* All the articles | -3 | 0 |
| -18°C Beefsteak | -3 | 3 |
| -18°C A mixture of ground beef and ground pork | -3 | 9 |
| -18°C Tuna | -3 | 6 |

* No thawing was required in the case of -7°C (When the articles was put at a room temperature.)

*1 REFRIGERATING COMPARTMENT
*2 FREEZER COMPARTMENT
*3 HIGH TEMPERATURE
*4 MEDIUM TEMPERATURE
*5 LOW TEMPERATURE
*6 SWITCHABLE COMPARTMENT
*7 REFRIGERATING COMPARTMENT
*8 CHILLED COMPARTMENT
*9 NEW TEMPERATURE ZONE OF COMPARTMENT
*10 FREEZER COMPARTMENT
*11 ICING TEMPERATURE

REFRIGERATOR WITH A FREEZER COMPARTMENT

REFRIGERATOR WITH A FREEZER COMPARTMENT

The present invention relates to a refrigerator with freezer compartment, which includes a new temperature zone of freezer compartment or a switchable compartment swichable to the new temperature zone of freezer compartment, and a refrigerator with a freezer compartment, which is easy to use, provides space saving and has a compact size.

Conventional refrigerators have a main body formed by an outer casing and an inner casing with a heat insulating material formed and filled therebetween, and have the inside of the main body divided into a plurality of temperature zones to provide a plurality of storage compartments having a temperature suited to each food. Although top freezer type refrigerators which have a freezer compartment 200 at an upper position therein, a refrigerating compartment 100 at a middle position therein and a vegetable compartment 500 at a lower position therein as shown in FIG. 26 have been dominant, the layout in refrigerators have become recently changed. In FIG. 27 is shown a mid-freezer type refrigerator which includes a refrigerating compartment 100 with a door at an upper position therein, freezer compartments 200, 250 with a drawable door provided at upper and lower separate locations at a middle position therein, and a vegetable compartment 500 with a door at a lower position therein as disclosed in, e.g., JP-A-5223431. In FIG. 28 is shown a middle vegetable compartment type refrigerator, which includes a refrigerator compartment 100 with a door at upper position therein, a vegetable compartment 500 with a door at a middle position therein, and freezer compartments 200, 250 provided at upper and lower separate locations at a lower position therein as disclosed in, e.g., JP-A9113111. In FIG. 29 is shown a select type refrigerator, which includes a refrigerator compartment 100 with a door at an upper position therein, an ice storing compartment 600 with a door and a switchable compartment 330 with a door provided on right and left sides at a middle position therein, a vegetable compartment 500 with a door under the ice storing compartment and the switchable compartment, and a freezer compartment 200 with a door at the lowest position therein as disclosed in, e.g., JP-A-11080666. Such various layout have been proposed.

The diversification in the layouts of the conventional refrigerators is reflected by difference in life style in terms of which food users mainly consume. The conventional top freezer type refrigerator is based on a technological principle that the provision of a freezer compartment having the lowest temperature at an upper position is effective since cooled air moves from upward toward downward in free convection because of being heavier than warm air. The latest layout in the refrigerator is that a refrigerating compartment, which has the greatest frequency of use, is provided at an upper position. Without stooping, users can open a door of a refrigerator to take foods in and out of the refrigerator, and he or she can shorten the time required to look for a desired article of food since stored foods are right before his or her eyes.

The mid-freezer type refrigerator is that a freezer compartment with a door is provided at a lower position as an easy-to-use height in the refrigerator since supply of various frozen-foods on the market or an increase in the number of dual-income families has increased the necessity for preservation of food in freeze. On the other hand, the middle vegetable compartment type is suited to users who have frequent access to a vegetable compartment, which is provided at the lowest position in case of the mid-freezer type. Both types are characterized in that foods, which are more frequently consumed next to the foods stored in a refrigerating compartment, are stored at such a height that users can take out foods without stooping. There are, of course, merits and demerits, and the middle vegetable compartment type is difficult to take out ice cubes stored in a freezer compartment.

The select type refrigerator is that an ice storing compartment as a part of a freezer compartment is provided between a refrigerating compartment and a vegetable compartment and that a switchable compartment with a door independent from the ice storing compartment is provided beside the ice storing compartment since the ice storing compartment is not required to have occupy the entire width of the refrigerator. The select type refrigerator can cope with differences in the frequency of use of foods by users since the refrigerator includes the refrigerating compartment, the ice storing compartment and the vegetable compartment at heights to take foods in and out of the compartment without users' stooping, and since the refrigerator also includes the switchable compartment where the temperature therein can be set according to users, desire.

The layouts in the conventional refrigerators have been explained. Next, the preserving temperature zones for foods will be explained. In FIG. 30 is shown a schematic view of the layout and the paths in a refrigerator disclosed in, e.g. JP-A-11080666. In this Figure, reference numeral 1 designates a refrigerator main body, reference numeral 100 designates a refrigerating compartment, reference numeral 600 designates an ice storing compartment, reference numeral 330 designates a switchable compartment, reference numeral 500 designates a vegetable compartment, and reference numeral 200 designates a freezer compartment. Reference numeral 700 designates an icing temperature compartment, which is provided in the refrigerating compartment 100.

Cooled air, which has been generated by a cooling device 4 housed behind the vegetable compartment 500 and the freezer compartment 200 in the refrigerator, is supplied to the respective compartments by a fan 5 provided above the cooling device 4. The cooled air is supplied from the fan 5 directly to the ice storing compartment 600 and the freezer compartment 200. The cooled air is supplied to the refrigerating compartment 100 through a cooled air supply controller 6X for the refrigerating compartment provided behind the refrigerating compartment. The cooled air is supplied to the switchable compartment 330 through a cooled air supply controller 6Y for the switchable compartment provided behind the switchable compartment. With respect to the vegetable compartment 500, cooling is carried out by an air path arrangement wherein the cooled air that has cooled the refrigerating compartment 100 is circulated in the vegetable compartment 500 and then is returned to the cooling device 4.

The temperature zones in the respective compartments are determined so that the freezer compartment and the ice storing compartment are set at from −18° C. to −20° C., the refrigerating compartment is set at from 3° C. to 5° C., the icing temperature compartment (chilled compartment or partially freezing compartment) is set at from 0° C. to 3° C. and the vegetable compartment is set at from 3° C. to 7° C., for instance. The temperature zones are determined, mainly considering the storing terms and the kinds of stored food. The switchable compartment can be set at a temperature in each of the temperature zones.

In particular, the icing temperature compartment can provide a longer storing term than the refrigerating compartment or the vegetable compartment to realize about one week of storage. The freezer compartment can realize about one month of storage by freezing articles of food.

Recently, an increase in the number of families with not higher than two persons and an increase in the number of woman workers caused by a decrease in the number of children have demanded a further decrease in housework. From this viewpoint, the icing temperature compartment and the freezer compartment have had an increased frequency of use.

However, the icing temperature compartment, for instance, can not always provide a proper temperature for a long term of food storage. This is because the icing. temperature compartment has a temperature zone from 0° C. to −3° C., and because there is a good possibility that the temperature in the icing temperature compartment is in a range from −1° C. to −5° C. as a maximum ice forming temperature zone wherein the moisture in articles of food starts freezing and the articles are in such an unstable state to be likely to denature.

The increased number of woman workers increases opportunities to buy required articles of food on weekends. Although it is supposed to usually buy meat, fish and so on required for one week on weekends, it is often impossible to use up the bought meat and fish in one week because of a sudden change in planned meals or a change in the amount of use. In such cases, it is usual to store articles of food in the freezer compartment in consideration of safety since the one week of storage in the icing temperature compartment is insufficient.

Although the freezer compartment can provide a quite longer term of storage than the icing temperature compartment by freezing articles of food, there is a case that a drop in the temperature of the articles of food to −18° C. completely freezes the moisture in the articles of food to damage surfaces of the articles of food or make the articles of food tasteless.

In addition, it is necessary to thaw an article of food for cooking since the article is completely frozen. It is usual to spontaneously thaw an article of food or thaw an article of food by a microwave oven and so on. It usually takes more than one hour to spontaneously thaw an article of food, making the thawing extremely troublesome. Although it takes a shorter time to thaw an article of food by a microwave oven, it is often to heat the surface of the article too much when a central portion in the article starts being thawed. This is because an article of food is gradually thawed from the surface thereof toward the central portion thereof. Unless next required part of an article of food is separated from the entire article before freezing the entire article, it is necessary to thaw the entire article at one time since the frozen article is too hard to separate the next required part from the entire article.

If a procedure wherein even unused part of an article of food is also thawed and frozen again is repeated, the article of food has freshness degraded, and it takes some time for thawing and cooking, which is contradictory to a decrease in housework.

From this viewpoint, the switchable compartment 330 is provided with a function to be switchable to a new temperature zone freezer compartment that can provide a longer term of food storage than an icing temperature compartment and minimize the degradation of stored articles of food.

Although, the new temperature zone of freezer compartment significantly contributes to make users' housework effective as stated earlier, the new temperature zone of freezer compartment can not perform all functions of the conventional freezer compartment. For example, firstly, the ice storing compartment is required to have the conventional refrigerating temperature (−18° C.) since the ice making speed is extremely slow at the temperature in the new temperature zone of freezer compartment (−7° C.). Secondly, other foods, such as frozen-foods and icecream, are required to be preserved in freeze (−18° C.) to maintain the quality. The freezing temperature zone in the freezer compartment is suited to store foods for a long term, such as one month, as stated earlier.

Among the conventional refrigerators, only refrigerators which include a switchable compartment provided independently of a freezer compartment and an ice storing compartment and provided beside the ice storing compartment in a shorter width than the entire width of the refrigerator main body are provided with the new temperature zone of freezer compartment from this viewpoint. The refrigerators having a function to be switchable to the new temperature zone of freezer compartment are mainly ones with five doors and limited to expensive ones having a great volume not less than 350 l. In addition, the conventional refrigerators can not increase the volume therein since the cooling device and the cooled air supply controllers need great spaces. When the volume in a refrigerator is increased, a family with a small kitchen can not accept the refrigerator since the refrigerator needs a wide space. Conventional middle and small size of refrigerators are inconvenient to users since the temperature zone of the respective compartments can not be changed.

It is an object of the present invention to solve these problems, and to provide a function of a new temperature zone of freezer compartment having a great storage capacity to a middle or small size of refrigerator, which is suited to families with few members, such as newly married couples and old persons, and which has a volume of not greater than 350 l. It is another object of the present invention to provide a refrigerator with a freezer compartment, which needs a small space and convenient to use, and which contributes to make the users' housework effective. It is another object of the present invention to provide a reliable refrigerator with a freezer compartment. It is another object of the present invention to a method for circulating cooled air in a refrigerator with high reliability.

According to a first aspect of the present invention, there is provided a refrigerator with a freezer compartment, comprising a refrigerating compartment provided at an upper position therein; a freezer compartment provided at a lower position therein; and a new temperature zone of freezer compartment or a switchable compartment provided between the refrigerating compartment and the freezer compartment therein, the new temperature zone of freezer compartment working as a compartment having a new temperature zone of not higher than a maximum ice forming temperature zone and higher than a freezing temperature zone, the switchable compartment being a compartment switchable to at least one of the new temperature zone, the freezing temperature zone, an ice forming temperature zone, a refrigerating temperature zone and a vegetable compartment temperature zone or a wine preserving temperature zone; wherein the new temperature zone of freezer compartment or the switchable compartment occupies substantially an entire width of the refrigerator.

According to a second aspect of the present invention, the refrigerator further comprises the refrigerating compartment having a door supported on one side thereof; and a container provided therein to store vegetables or other groceries.

According to a third aspect of the present invention, a machine space with a compressor therein, a cooling device generating cooled air to be circulated in the refrigerator, a fan for circulating the cooled air, and a cooled air supply controller for distributing the cooled air are provided at a lower position than the refrigerating compartment, and a cooled air outlet path for the refrigerating compartment is provided at a higher position than the refrigerating compartment.

According to a fourth aspect of the present invention, the cooled air supply controller has at least two cooled air outlets provided therein in front and rear directions with respect to the refrigerator.

According to a fifth aspect of the present invention, the refrigerator further comprises a first partition provided between the refrigerating compartment and the new temperature zone of freezer compartment or the switchable compartment and having a heat insulating material therein; a second partition provided between the new temperature zone of freezer compartment or the switchable compartment and the freezer compartment, and having a heat insulating material therein; the machine space provided at a lower rear position in the refrigerator; the cooling device provided behind the freezer compartment; the fan provided behind the new temperature zone of freezer compartment or the switchable compartment; and the cooled air supply controller provided beside the fan; wherein the machine space, the cooling device, the fan and the cooled air supply controller are provided under the first partition.

According to a sixth aspect of the present invention, the cooled air supply controller has at least two cooled air outlets, and the cooled air supply controller has a rear cooled air outlet connected to a cooled air supply path for the refrigerating compartment in the fourth aspect.

According to a seventh aspect of the present invention, the refrigerator comprises the refrigerating compartment and the new temperature zone of freezer compartment or the switchable compartment, and the refrigerator further comprises a cooled air supply path extending from a cooled air outlet of the cooled air supply controller to the new temperature zone of freezer compartment or the switchable compartment; a partition provided between the refrigerating compartment and the new temperature zone of freezer compartment or the switchable compartment, and having a heat insulating material therein, the partition having the cooled air supply path formed therein; and a heat insulating material provided between the cooled air supply path and the new temperature zone of freezer compartment or the switchable compartment.

According to an eighth aspect of the present invention, the refrigerator comprises the refrigerating compartment and the new temperature zone of freezer compartment or the switchable compartment, and the refrigerator further comprises a container provided at a lower position in the refrigerating compartment to store foods in a temperature zone different from portions in the refrigerating compartment except for the container; and a container provided in the new temperature zone of freezer compartment or the switchable compartment; wherein the container in the refrigerating compartment is slidable in front and rear directions with respect to the refrigerator; and the container in the refrigerating compartment has a rear wall located at a position backwardly of a position of a rear wall of the container in the new temperature zone of freezer compartment or the switchable compartment.

According to a ninth aspect of the present invention, the refrigerator comprises the new temperature zone of freezer compartment or the switchable compartment, and the new temperature zone of freezer compartment or the switchable compartment includes a drawable door and a container mounted thereto; and a horizontal distance between a front surface of a refrigerating compartment door and a rear wall surface of the container with a drawable door drawn out is determined so that a user can survey even a deepest portion in the container without stooping.

According to a tenth aspect of the present invention, there is provided a refrigerator with a freezer compartment comprising a refrigerating compartment; a freezer compartment; and a cooling device; wherein cooled air returned from the refrigerating compartment is sucked into the cooling device at a position in the vicinity of a central portion of the cooling device with respect to a longitudinal axis of the cooling device, and cooled air returned from the freezer compartment is sucked into the cooling device at a position farther from the central portion than the sucked position of the cooled air returned from the refrigerating compartment with respect to the longitudinal axis of the cooling device.

According to an eleventh aspect of the present invention, the refrigerator in the tenth aspect further comprises a new temperature zone of freezer compartment or a switchable compartment therein, wherein cooled air returned from the new temperature zone of freezer compartment or the switchable compartment is sucked into the cooling device at a position in the vicinity of the central portion.

According to a twelfth aspect of the present invention, the refrigerator in the tenth aspect further comprises a machine space with a compressor therein, a cooling device for generating cooled air to be circulated in the refrigerator, a fan for circulating the cooled air, and a cooled air supply controller for distributing the cooled air are provided at a lower position than the refrigerating compartment, wherein a cooled air outlet path for the refrigerating compartment is provided at a higher position than the refrigerating compartment.

According to a thirteenth aspect of the present invention, there is provided a refrigerator comprising a refrigerating compartment provided at an upper portion therein wherein a machine space with a compressor therein, a cooling device for generating cooled air to be circulated in the refrigerator, a fan for circulating the cooled air, and a cooled air supply controller for distributing the cooled air are provided at a lower position than the refrigerating compartment and wherein the cooled air supply controller has at least two cooled air outlets provided in front and rear directions with respect to the refrigerator.

According to a fourteenth aspect of the present invention, the cooled air supply controller has at least two cooled air outlets provided in the front and rear directions with the refrigerator, and the cooled air supply controller has a rear cooled air outlet connected to a cooled air supply path for the refrigerating compartment in the thirteenth aspect.

According to a fifteenth aspect of the present invention, there is provided a refrigerator comprising a plurality of compartments; at least one of the compartments having a door supported on one side thereof, and having a container having a temperature zone different from portions in the at least one compartment except for the container; and a temperature sensor and a cooled air supply controller, both of which independently control a temperature in the container; wherein the temperature in the container is switchable to the new temperature zone, or at least one of a freezing temperature zone, an ice forming temperature zone, a refrigerating temperature zone, a vegetable compartment temperature zone and a wine preserving temperature zone.

According to a sixteenth aspect of the present invention, the refrigerator comprises a plurality of compartments; and at least one of the compartments having a door supported on one side thereof, and having a container having a temperature zone different from portions in the at least one compartment except for the container; wherein the container has a heat insulating material provided therearound.

According to a seventeenth aspect of the present invention, the refrigerator comprises a compartment having a door; a container provided at a lower portion in the compartment and cooled in a temperature zone different from portions in the compartment except for the container, the container having a front end; and a shelf working as a top wall for the container; wherein the shelf and the front end have a heat insulating material provided thereon.

According to an eighteenth aspect of the present invention, the refrigerator comprises a new temperature zone of freezer compartment working as a compartment having a new temperature zone of not higher than a maximum ice forming temperature zone and higher than a freezing temperature zone, wherein the new temperature zone of freezer compartment has a temperature set to a temperature that foods preserved in the new temperature zone of freezer compartment can be cut without being thawed.

According to a nineteenth aspect of the present invention, the refrigerator comprises a switchable compartment having a selection of set temperature zones, wherein the switchable compartment is switchable to at least one of the new temperature zone, the freezing temperature zone, the ice forming temperature zone, the refrigerating temperature zone and the vegetable compartment temperature zone or the wine preserving temperature zone.

According to a twentieth aspect of the present invention, the refrigerator comprises a partition surface forming a bottom surface of the refrigerating compartment under the container; an inlet for a cooled air return path for the refrigerating compartment, provided in the partition surface; and a slide rail for the container provided on the partition surface; wherein the inlet is formed a position in the partition surface except for the slide rail or its extension.

According to a twenty-first aspect of the present invention, the refrigerating compartment has a temperature therein switchable to the ice forming temperature.

According to a twenty-second aspect of the present invention, the refrigerator comprises the refrigerating compartment having a door supported on one side thereof, the freezer compartment, and the new temperature zone of freezer compartment or the switchable compartment, wherein the new temperature zone of freezer compartment or the switchable compartment has a container, which is mounted to a drawable door movable with respect to the refrigerator.

According to a twenty-third aspect of the present invention, the refrigerator comprises a lamp cover provided in the refrigerating compartment, the lamp cover having at least one cooled air inlet into the lamp cover and at least one cooled air outlet from the lamp cover.

According to a twenty-fourth aspect of the present invention, there is provided a method for circulating cooled air in a refrigerator including a plurality of compartments having different temperature zones, comprising the steps of circulating, in a refrigerating compartment, cooled air generated by a cooling device, and returning the cooled air returned from the refrigerating compartment to the cooling device at a position in the vicinity of a central portion of the cooling device with respect to a longitudinal axis of the cooling device; and circulating, in a freezer compartment, the cooled air generated by the cooling device, and returning the cooled air returned from the freezer compartment to the cooling device at a position far from the central portion with respect to the longitudinal axis of the cooling device.

According to a twenty-fifth aspect of the present invention, there is provided a method for circulating cooled air in a refrigerator, comprising the steps of circulating, in the new temperature zone of freezer compartment or the switchable compartment, cooled air generated by the cooling device, and returning the cooled air returned from the new temperature zone of freezer compartment or the switchable compartment to the cooling device at a position in the vicinity of a central portion of the cooling device with respect to a longitudinal axis of the cooling device.

In accordance with the first aspect, a middle or small size of refrigerator, which is convenient to families with few members, such as newly married couples and old persons, can be provided with the new temperature zone of freezer compartment, which has a greater storage capacity than the conventional new temperature zone of freezer compartment.

In accordance with the second aspect, a middle or small size of refrigerator, which is relatively economical and has a volume not greater than 350 l, can have a container to preserve vegetables and other groceries in addition to the refrigerating compartment, the freezer compartment and the new temperature zone of freezer compartment. In addition, storing foods for longer preservation than an icing temperature compartment and saving the trouble for cooking to make housework effective can be realized in a middle size or less of refrigerator, which is convenient to families with few members, such as newly married couples and old persons.

In accordance with the third aspect, a middle size or less of refrigerator, which is convenient to families with few members, such as newly married couples and old persons, can be provided with a great volume in a compact size and, in particular, the refrigerating compartment with an available space extended in a depth direction.

In accordance with the fourth aspect, a middle size or less of compact refrigerator, which is convenient to families with few members, such as newly married couples and old persons, can be provided with a cooling unit reduced in a width direction, with a new temperature zone of freezer compartment, and with the refrigerating compartment with an available space extended in a depth direction.

In accordance with the fifth aspect, the dead space can be minimized since the devices forming the cooling unit are collectively provided behind the freezer compartment and the new temperature zone of freezer compartment under the first partition. As a result, a middle size or less of refrigerator, which is convenient to families with few members, such as newly married couples and old persons, can be provided with a great volume in a compact size and, in particular, the refrigerating compartment with an available space extended in a depth direction.

In accordance with the sixth aspect, the cooled air supply path to the refrigerating compartment, which is provided behind the refrigerating compartment, can be provided in a thinner size since the air path extends along the rear wall of the refrigerating compartment to be connected to the rear outlet of the cooled air supply controller. Thus, a middle size or less of refrigerator, which is convenient to families with few members, such as newly married couples and old persons, can be provided with a great volume in a compact size and with the refrigerating compartment with an available space extended in a depth direction.

In accordance with the seventeenth aspect, there is provided a middle size or less of refrigerator, which can prevent a top surface of the new temperature zone of freezer compartment or the switchable compartment from being dewed, and is easy for families with few members, such as newly married couples and old persons, to use.

In accordance with the eighth aspect, there is provided a refrigerator, which is easy to use and has a container for preserving vegetables and other groceries in a great storage volume.

In accordance with the ninth aspect, a user can survey even the deepest portion in the container without stooping. In addition, the refrigerator is easy to use since a user, such as, in particular, a woman and an old person, does not need to take a difficult posture.

In accordance with the tenth aspect, the frost on the cooling device that is caused by the returned cooled air from the refrigerating compartment and that contains much moisture because of being more humid than the returned cooled air from the freezer compartment can be grown from a central position of the cooling device to be uniformly deposited on the cooling device, reducing a decrease in cooling capacity because of the frost deposition.

In accordance with the eleventh aspect, the frost on the cooling device that is caused by the returned cooled air from the new temperature zone of freezer compartment and that contains much moisture because of being more humid than the returned cooled air from the freezer compartment can be grown from a central position of the cooling device to be uniformly deposited on the cooling device, reducing a decrease in cooling capacity because of the frost deposition.

In accordance with the twelfth aspect, a middle size or less of refrigerator, which is convenient to families with few members, such as newly married couples and old persons, can be provided with a great volume in a compact size and, in particular, the refrigerating compartment with an available space extended in a depth direction.

In accordance with the thirteenth aspect, the cooling unit can have the width size reduced. Thus, a middle size or less of easy-to-use refrigerator, which is convenient to families with few members, such as newly married couples and old persons, can be provided, having a small width in a compact size.

In accordance with the fourteenth aspect, the cooled air supply path to the refrigerating compartment, which is provided behind the refrigerating compartment, can be provided in a thinner size since the air path extends along the rear wall of the refrigerating compartment to be connected to the rear outlet of the cooled air supply controller. A middle size or less of refrigerator, which is convenient to families with few members, such as newly married couples and old persons, can be provided with a great volume in a compact size and with the refrigerating compartment with an available space extended in a depth direction.

In accordance with the fifteenth aspect, not only the drawable compartment but also the container in the refrigerating compartment can have a choice of set temperatures, providing a middle size or less of refrigerator, which can further improve the convenience in food storage and can have a choice of set temperatures to enable various usages.

In accordance with the sixteenth aspect, the refrigerator can ensure to maintain the inside of the container at a set temperature and is highly reliable.

In accordance with the seventeenth aspect, the container and the shelf closest to the container can prevent from being dewed by a temperature difference between inside and outside the container.

In accordance with the eighteenth aspect, families with few members, such as newly married couples and old persons, can be provided with ease to use and effectiveness in housework since an article of food can be taken out of the refrigerator and be cut into small pieces instantly.

In accordance with the nineteenth aspect, a convenient-to-use and practical-to-use refrigerator with a freezer compartment can be provided to families with few members, such as newly married couples and old persons.

In accordance with the twentieth aspect, matters put on the bottom wall of the refrigerating compartment, such as scraps of vegetables and drops of water, can be prevented from being dropped in the inlets in the bottom wall by the sliding movement of the container for preserving vegetables and other groceries.

In accordance with the twenty-first aspect, even when the switchable compartment is used as the new temperature zone of freezer compartment, foods can be preserved in the icing temperature zone in the refrigerator to provide the refrigerator with various usages because of improved convenience in food storage.

In accordance with the twenty-second aspect, users can visually check the stored foods in a natural posture and take foods in and out of the refrigerator without users' stooping, or short women's or old persons' standing on tiptoes.

In accordance with the twenty-third aspect, the lamp in the lamp cover can be cooled. In addition, the number of the outlets can be increased by the number of the outlets formed in the lamp cover to uniformly cool the inside of the refrigerating compartment, improving the temperature distribution in the refrigerating compartment.

In accordance with the twenty-fourth aspect, the frost on the cooling device that is caused by the returned cooled air from the refrigerating compartment and that contains much moisture because of being more humid than the returned cooled air from the freezer compartment can be grown from a central position of the cooling device to be uniformly deposited on the cooling device, reducing a decrease in cooling capacity because of the frost deposition.

In accordance with the twenty-fifth aspect, the frost on the cooling device can be grown from a central position of the cooling device to be uniformly deposited on the cooling device, reducing a decrease in cooling capacity because of the frost deposition.

In the drawings;

FIG. 6 is a table showing acceptable storing terms for articles of food in storing compartments having different storing temperatures:

FIG. 7 is a table showing times that articles of foods stored at −18° C. took to become cuttable in different thawing method;

FIG. 8 is a table showing surface temperatures of articles of food stored at −7° C. and −18° C. when having been thawed in a microwave oven;

Now, preferred embodiments of the present invention will be described in detail.

EMBODIMENT 1

A first embodiment of the present invention will be explained.

Figure 1:
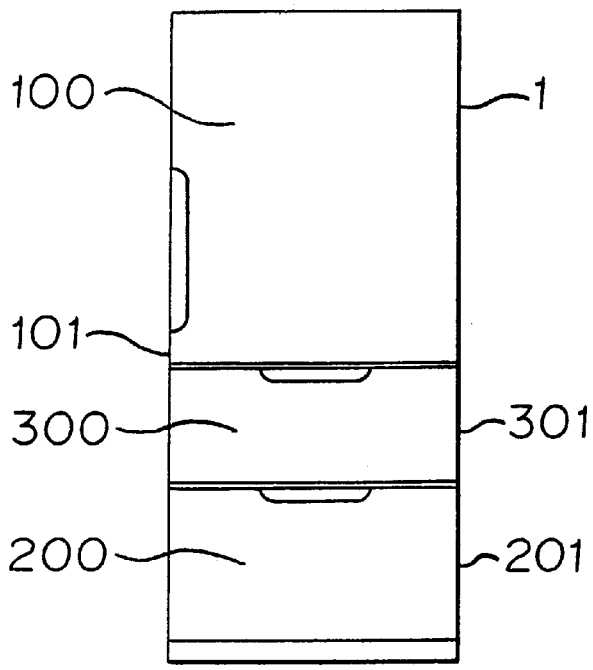
FIG. 1 is a front view of the refrigerator with a freezer compartment according to a first embodiment of the present invention.
Figure 2:
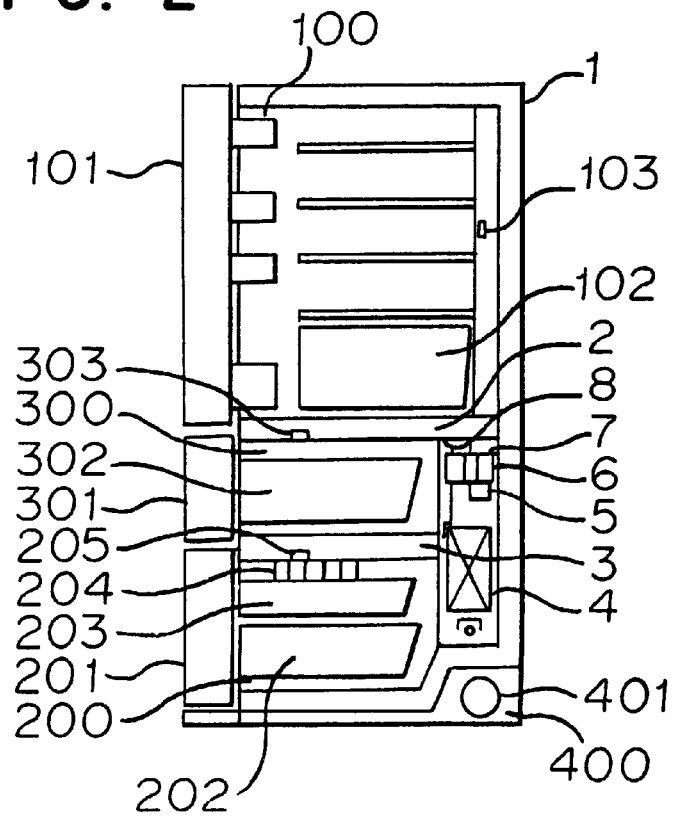
FIG. 2 is a cross-sectional side view of the refrigerator according to the first embodiment.

In FIG. 1 is shown a front view of the refrigerator according to the first Embodiment. In FIG. 2 is shown a cross-sectional side view of the refrigerator main body, wherein the air path arrangement in the first Embodiment is shown. In FIGS. 1 and 2, reference numeral 1 designates the refrigerator main body, which includes a refrigerating compartment 100 with a door 101 at an upper position, a freezer compartment 200 with a door 201 at a lower position, and a new temperature zone of freezer compartment 300 with a door 301 between the refrigerating compartment 100 and the freezer compartment 200, which is a compartment having substantially the entire width of the refrigerator main body 1 and a temperature zone not higher than a maximum ice forming temperature zone (−1° C. to −5° C.) and higher than a freezing temperature zone (−18° C. to −20° C.).

Reference numeral 202 designates a container, which is attached to the drawable door 201 and provided in the freezer compartment 200 so as to be slidable in front and rear directions with respect to the refrigerator main body 1 for storing foods. In particular, the freezer compartment 200 is suited to store frozen-foods and food materials for relatively long preservation, and icecream having suggested preservation not higher than −15° C.

Reference numeral 203 designates an ice storing case, which is provided above the container 202, and which is slidable in the front and rear directions. Reference numeral 204 designates an ice making tray, which is provided above the ice storing case 203. Reference numeral 302 designates a container, which is attached to the drawable door 301 and is provided in the new temperature zone of freezer compartment 300 so as to be slidable in the front and rear direction with respect to the refrigerator main body 1 in order to store foods. At a lower position in the refrigerating compartment 100 is provided a container 102 for storing vegetables and other groceries, which is slidable in the front and rear directions with respect to the refrigerator main body 1 with the door 101 being opened, and which is a compartment having a temperature zone different from an upper portion in the refrigerating compartment so as to store foods and vegetables to be preserved at a higher temperature than the temperature zone of the refrigerating compartment 100, for instance.

The new temperature zone of freezer compartment, which has been provided at a position beside an ice storing compartment or other position only in a refrigerator having a great volume of not smaller than 350 l as in a five door refrigerator, is provided so as to a substantially the entire width of the refrigerator main body in addition to the refrigerating compartment and the freezer compartment in a middle or small size of refrigerator, which is relatively economical and has a volume not greater than 350 l. Thus, a middle or small size of refrigerator, which is convenient to families with few members, such as newly married couples and old persons, can be provided with the new temperature zone of the freezer compartment, which has a greater storage capacity than the conventional new temperature of freezer compartment.

Since the refrigerating compartment has the door supported at one side and the container for storing vegetables or other groceries provided therein, and since the new temperature zone of freezer compartment, which is a compartment having a temperature zone not higher than the maximum ice forming temperature zone and higher than the freezing temperature zone, is provided, a middle or small size of refrigerator, which is relatively economical and has a volume not greater than 350 l, can have a vegetable compartment in addition to the refrigerating compartment, the freezer compartment and the new temperature of freezer compartment having substantially the entire width of the refrigerator. In addition, storing foods for longer preservation than an icing temperature compartment and saving the trouble for cooking to make housework effective can be realized in a small size or less of refrigerator, which is convenient to families with few members, such as newly married couples and old persons. Since the refrigerating compartment, the freezer compartment and the new temperature of freezer compartment are provided, since the refrigerating compartment has the door supported at one side, and since the freezer compartment and the new temperature zone of freezer compartment (which may be a switchable compartment switchable to the new temperature zone of freezer compartment) have the drawable doors with the containers attached thereto so as to be movable in the front and rear directions with respect to the refrigerator main body, users can visually check the stored foods and take foods in and out of the refrigerator in a natural posture without users' stooping, or short women's or old persons' standing on tiptoe. Since the new temperature zone of freezer compartment is provided at a higher position than the freezer compartment at the lower position, users can take out foods with the drawable door drawn without stooping, which is suited to usage having a great frequency of use.

The new temperature zone of freezer compartment 300 can preserve foods for a longer term than the icing temperature compartment (at about 0° C. in the chilled compartment and at about −3° C. in the partially freezing compartment) and preserve meat, fish and other groceries intended to be consumed in two or three weeks in such a state that these groceries can be cut without being sawed. This is because the temperature in the new temperature of freezer compartment is set at a temperature in a temperature zone (between −9° C. and −5°) not higher than the maximum ice forming zone and higher than the freezing temperature zone. Since the moisture in food is not completely frozen unlike the preservation in the freezing temperature zone, the surface of the stored food can be prevented from being damaged and the taste is prevented from degraded. Articles of food with much moisture (such as curried food, stew, grated radish and baked eggplants) can not be frozen hard, avoiding a case wherein such food is desiccated to destroy taste or crispness.

Now, the new temperature zone of freezer compartment will be described in detail.

Figure 3:
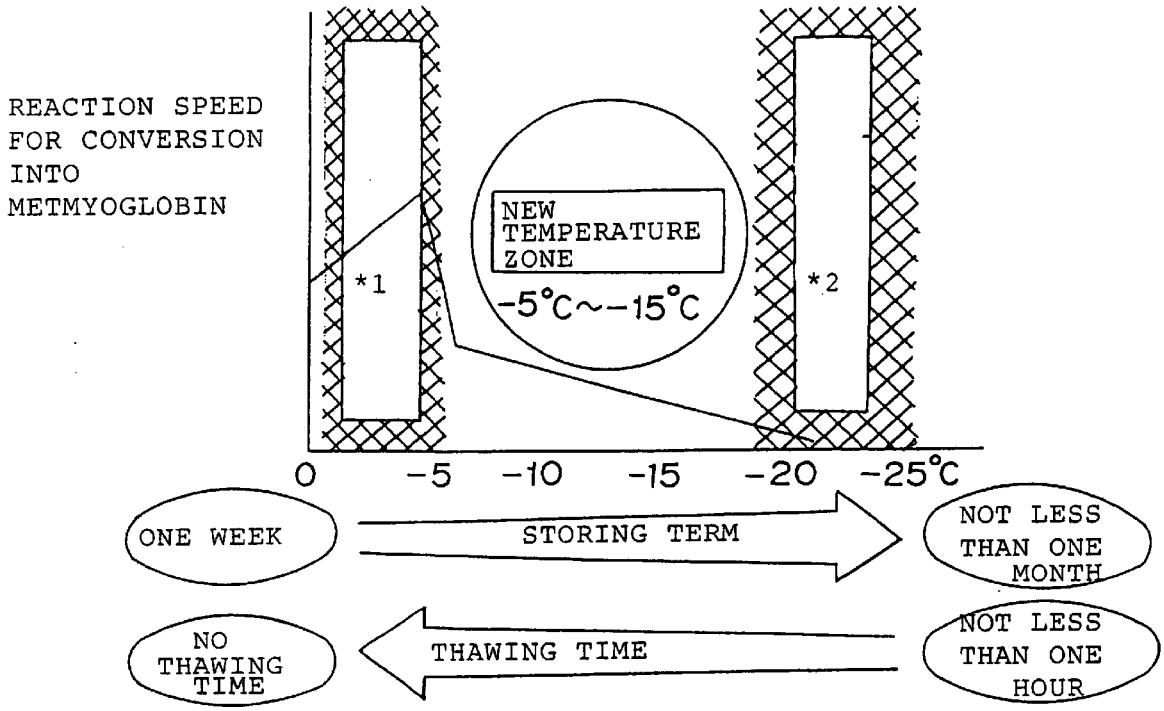
FIG. 3 is a graph showing the new temperature zone.

In FIG. 3 is shown reaction speeds for degree of change in the surface color of an article of food (conversion into metmyoglobin) with respect to storing temperatures. The ordinate represents reaction speeds for conversion to metmyoglobin, and the abscissa represents food storing temperatures. Under the abscissa are indicated a food storing term and a thawing time for the food. The reaction speeds for conversion into metmyoglobin take the maximum value in the maximum ice forming temperature zone of from −1° C. (upper limit) to −5° C. (lower limit) wherein moisture in articles of food start freezing. In the maximum ice forming temperature zone, articles of food are liable to be subjected to denaturation, takes an unstable state and degrades the surface color thereof. This means that the cells in the articles are damaged to make the articles tasteless.

The temperature in the new temperature zone of freezer compartment is set at not higher than −5° C. in order to store articles of food in such a way to avoid the maximum ice forming temperature zone. The temperature in the new temperature zone of freezer compartment may be set at a temperature value higher than, e.g., −15° C. in order to store articles of food in such a way to avoid the freezing temperature zone (not higher than −18° C.) since it takes some time to thaw articles of food frozen in the freezing temperature zone though the storing term can be long in the freezing temperature zone.

As explained, the articles of food in the new temperature zone of freezer compartment can not be frozen hard unlike articles of food stored in the ordinary freezer compartment since the articles of food in the new temperature zone of freezer compartment are stored in a range from −5° C. to −15° C. for instance. The articles of food in the new temperature zone of freezer compartment are softly frozen (subjected to soft-freezing, lightly frozen or cuttably frozen) so that the articles of food can be divided by a kitchen knife or hands. In addition, the storing term for the articles of food can be lengthened to not less than one week, and the articles of food can be kept in a better state than the articles of food in the icing temperature compartment for a long time.

Figure 4:
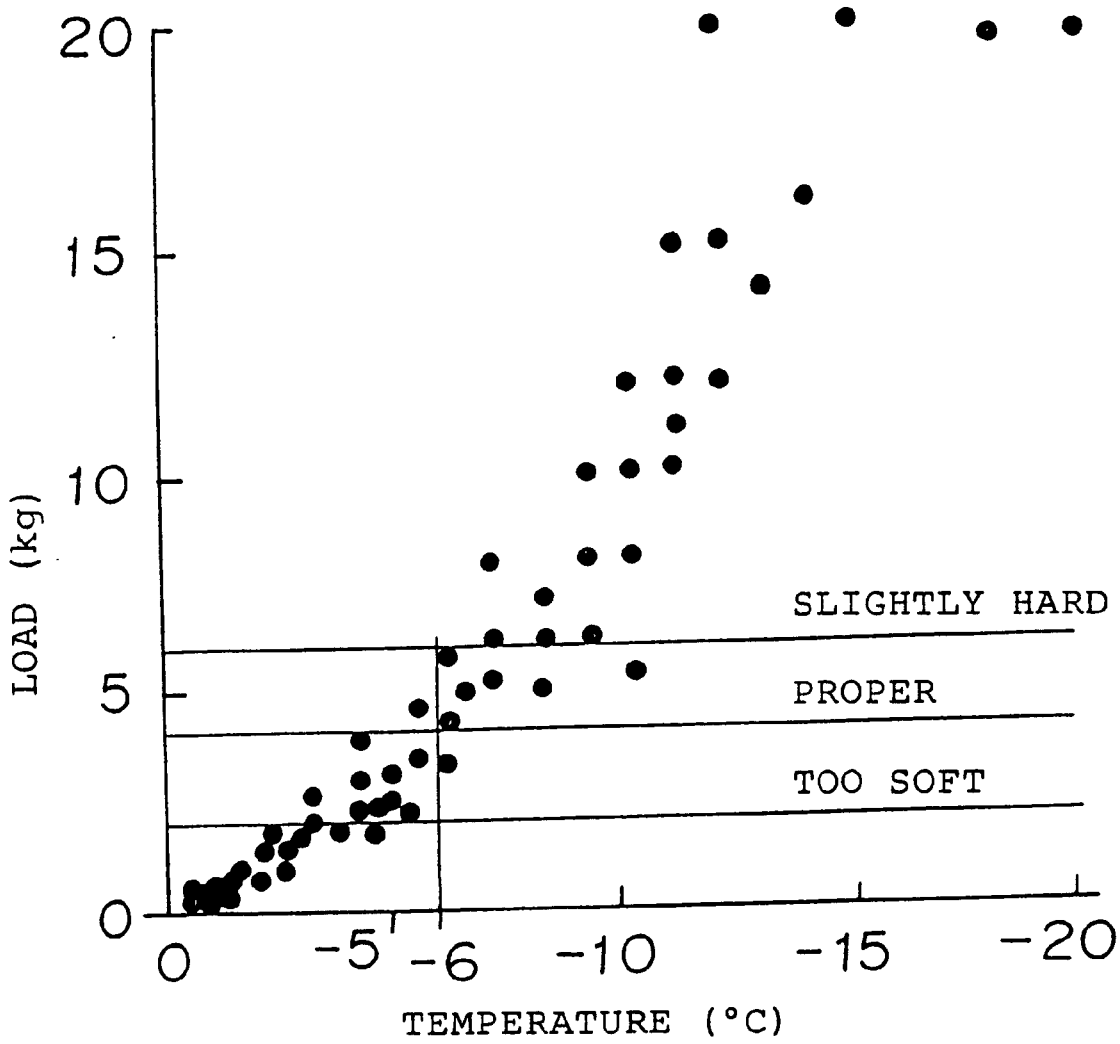
FIG. 4 is a graph showing the relationship between temperatures of an article of food and cutting loads in the new temperature zone.
Figure 5:
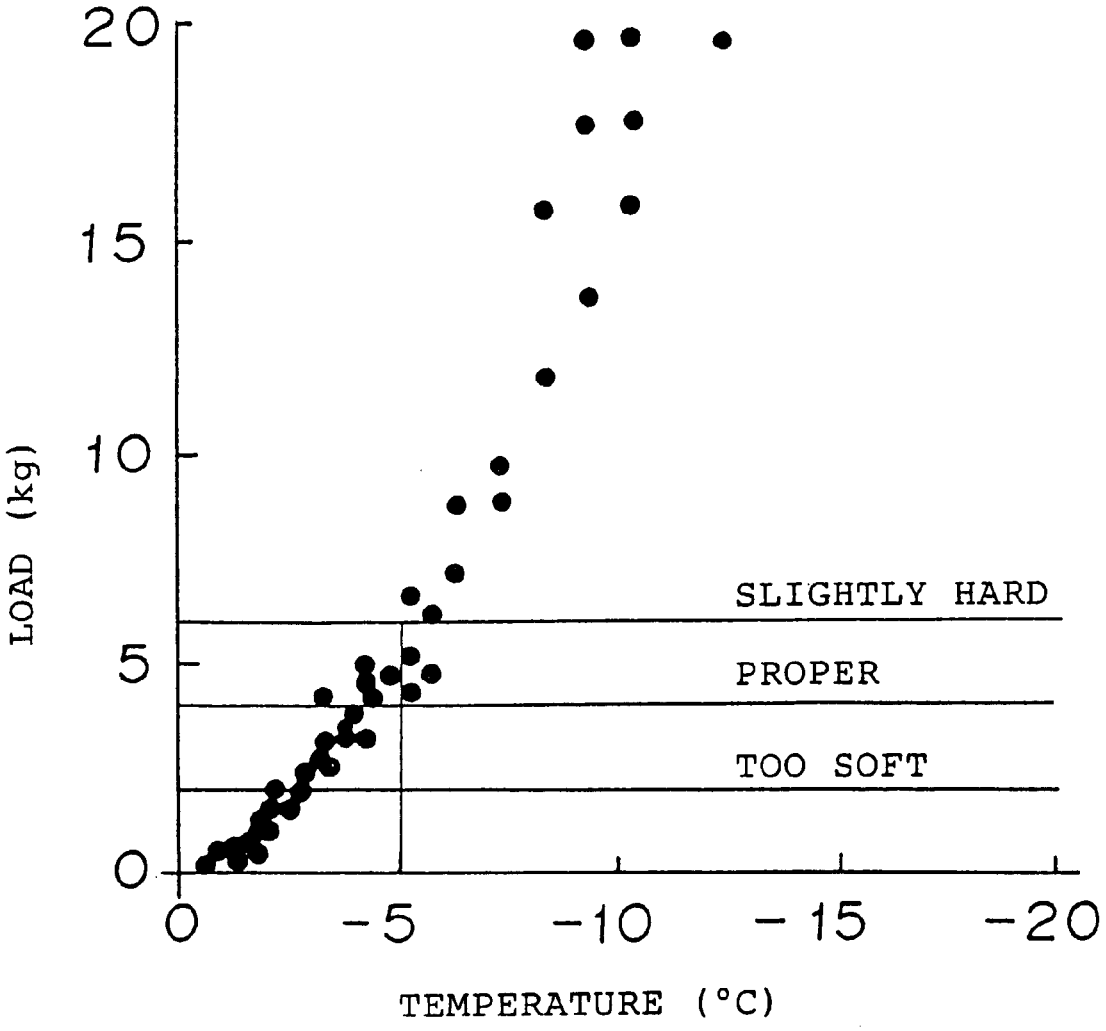
FIG. 5 is a graph showing the relationship between temperatures of another article of food and cutting loads in the new temperature zone.

In FIGS. 4 and 5 are shown data of the relationships between temperatures of articles of food and cutting loads, which indicate how a person feels about the articles of food (slightly hard, proper or too soft) when he or she actually cuts the articles with a knife and so on. In FIG. 4 is shown the results of tuna as the articles, and in FIG. 5 is shown the results of pork as the articles. It has been found that most articles of food are frozen properly hard or slightly hard so as to be cuttable when they are stored at a temperature from −5° C. to −7° C., and that the cutting loads are about from 5–6 kg at that time.

In FIG. 6 are shown acceptable storing terms for articles of food in storing compartments having different storing temperatures. The storing compartments are a chilled compartment (about 0° C.), a partially freezing compartment (about −3° C.) and a new temperature zone of compartment (about −70° C.).

In FIG. 6 are shown acceptable storing terms (days) under criteria for sashimi or fresh slices of raw fish (fresh slices of raw tuna), fish to be cooked (for tuna to be cooked), meat to be cooked (for ground meat to be cooked), branched (boiled) vegetables (broccoli) and processed food such as caned food (meat source). As the criteria are selected required ones among sensory evaluation criteria ① rotten, ② presence of stench and discoloration, ③ eatable limit, ④ presence of slight stench and discoloration, and ⑤ absence of stench or discoloration), a K value criterion, criterion of the numbers of bacteria on surface, and a criterion of the number of living bacteria. With regard to the K value, it is normally determined that when the value is not greater than 20%, articles of food are eatable without being heated, and that when the value is not greater than 60%, articles of food are at the eatable limit though being required to be heated. With respect to the number of bacteria on surface, it is normally determined that when the number is $10^4$, articles of food are at the eatable limit. With respect to the number of living bacteria, it is normally determined that when the number is $10^6$, articles of food are at the eatable limit. From this viewpoint, days that passed until articles of food reach at the eatable limit were found. The K value is a ratio of substance associated with ATP (adenosine triphosphate), which indicates the freshness index of articles of food.

With regard to the acceptable storing term for tuna sashimi or fresh slices of raw tuna, the days at respective storing temperatures are shown when the sensory evaluation was ④ and the K value was 20% as the criteria. With regard to the acceptable storing term in the case of tuna to be cooked, the days at respective storing temperatures are shown when the sensory evaluation was ③, the K value was 60% and the number of bacteria on surface was $10^4$ as the criteria. With respect to the acceptable storing term for ground meat to be cooked, for branched broccoli and for reheated meat source stored in a can commercially available, days at the respective storing temperatures are shown when the sensory evaluation was ③ and the number of living bacteria was $10^6$ as the criteria. The underlined values in Table 1 are the shortest ones among the acceptable storing terms (days) under respective pairs of criteria. For example, the acceptable storing term for tuna sashimi in the new temperature zone of freezer compartment was 14 days in terms of the sensory evaluation criteria and 30 days in terms of the K value criteria, and consequently the shortest acceptable storing term (the underlines portion) was 14 days.

According to these data, it has been determined that the new temperature zone (about −7° C.) can store articles of food not required to be cooked or heated for not less than 2 weeks and articles of food to be cooked for not less than 3 weeks, and that the new temperature zone can store articles of food for 2 or 3 weeks without causing trouble.

The data also show that the acceptable storing terms in the new temperature zone were days of not less than 3 times the temperature zone in the chilled compartment and days of not less than 2 times the temperature zone in the partially freezing compartment, and that the new temperature zone of compartment is superior to the chilled compartment or the partially freezing compartment in terms of the acceptable storing term. With respect to vegetable and processed products, the data show that the shortest acceptable storing terms were not less than 35 days. Since such articles of food vary in initial quality, storing of such articles of food at a lower temperature in the new temperature zone is superior in terms of convenience in separation of the articles or thawing of the articles and storage of the articles.

Now, thawing times for frozen articles of food are shown.

FIG. 7 shows how long articles of food stored at −18° C. take to become cuttable in different thawing methods (thawing in a refrigerating compartment, a room temperature and a microwave oven). FIG. 8 shows what surface temperature articles of food stored at −7° C. and articles of food stored at −18° C. have when being thawed in a microwave oven.

As shown in FIG. 7, thawing of articles of food in a refrigerating compartment or at a room temperature involves a troublesome work, such as taking out of the articles in advance, and a time-consuming work since it takes some time to thaw the articles. Thawing of articles of food in a microwave oven is not time-consuming though such a troublesome work is needed. When articles of food are stored at −7° C. in accordance with the present invention, the waiting time is 0 since articles of food are cuttable immediately after they are taken out.

As shown in FIG. 8, the articles of food stored at −7° C. had a surface temperature of 0° C. as the maximum value when having been thawed in a microwave oven. This value is much lower than surface temperatures of 3° C., 6° C. and 9° C. of the articles of food stored at −18° C. when having been thawed in the microwave oven. This means that the articles stored at −7° C. can minimize degration due to thawing.

Figure 9:
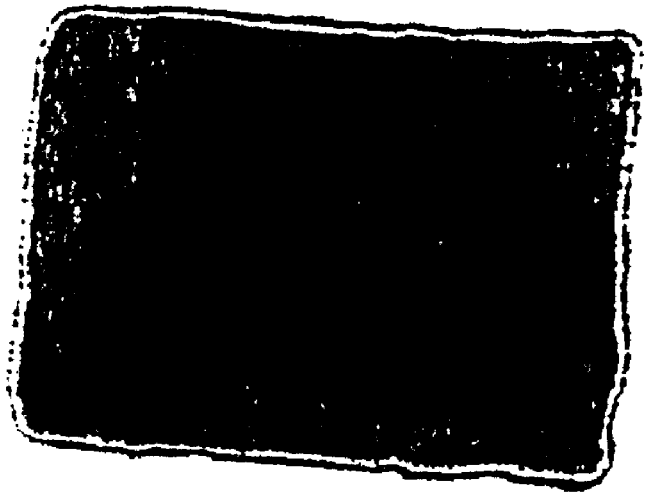
FIG. 9 is a view showing the distribution of surface temperatures of an article of food, which has been stored at −7° C. and is taken out in a room temperature.
Figure 10:
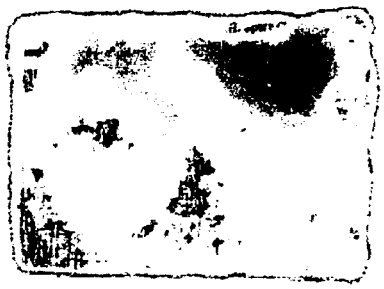
FIG. 10 is a view showing the distribution of surface temperature of another article of food, which has been stored at −18° C. and is thawed in a microwave oven.

In FIG. 9 is shown a surface temperature distribution of an article of food that had been stored at −7° C. and was taken out in a place at a room temperature. In FIG. 10 is shown a surface temperature distribution an article of food that had been stored at −18° C. and was thawed in a microwave oven. In FIG. 9, the entire surface of the meat was in the same color, and the surface temperature of the article was equal in the entirety. In FIG. 10, the surface of the meat varied in color and the surface temperature of the article had a wide distribution. The article shown in FIG. 10 had higher temperatures in the entirety than the articles shown in FIG. 9. When ground meat was thawed in the microwave oven, fatty portions of the ground meat had higher temperatures since the portions were apt to be selectively heated. The surface temperature distribution after thawing varies on the storing temperature for an article of food.

This shows that since articles of food stored at −7° C. can be thawed without using a microwave oven and so on (can be used without being thawed), it is possible to avoid an uneven temperature distribution or degration due to overthawing, which is caused when articles of food stored at −18° C. are thawed in a microwave oven.

As explained, the new temperature zone is superior to other temperature zones in terms of the time that articles of food take to be thawed to a cuttable temperature. The fact that articles of food can be cut immediately after being taken out results in a reduction in the time required for housework since finely cutting of, e.g., ground meat taken out enlarges an area of the article to be exposed to air, thereby accelerating thawing, and since cutting articles of food immediately after taking out is very convenient even when the articles are thawed in a raw state.

In this embodiment, the volume ratios of the respective compartments are set at about 70% for the refrigerating compartment, about 20% for the freezer compartment and about 10% for the new temperature zone of freezer compartment. This embodiment can provide a middle or small size of refrigerator, which is suited to the food storing amount, the food storing term and the life pattern in cooking of families with few members, such as newly married couples and old persons, and which is conveniently utilized by these persons.

The food preservation in the new temperature zone of freezer compartment as stated earlier is useful for women, who need a reduction in housework because of having work as stated earlier, or old persons, who consume foods in a small amount at one time though buying the foods at one time. This embodiment can provide a middle size or less of refrigerator, which can preserve foods in a greater amount than before and is easy for families with few members, such as newly married couples and old persons, to use. This is because the new temperature zone of freezer compartment is provided so as to have substantially the entire width of the refrigerator main body.

Now, an air path arrangement and a cooling method according to this embodiment will be described. In FIG. 2, reference numeral is a first partition, which is provided between the refrigerating compartment 100 and the new temperature zone of freezer compartment 300 thereunder, and which includes a heat insulating material. Reference numeral 3 is a second partition, which is provided between the new temperature zone of freezer compartment 300 and the freezer compartment 200 thereunder, and which includes a heat insulating material.

Reference numeral 400 designates a machine space, which is provided at a lower rear end in the refrigerator main body 1 to house a compressor 401. Reference numeral 4 designates a cooling device, which is provided above the machine space 400 and behind the freezer compartment 200. Reference numeral 5 designates a fan, which is provided above the cooling device 4 and behind the new temperature zone of freezer compartment 300. Reference numeral 6 designates a cooled air supply controller, which is provided beside the fan 5. The machine space 401, the cooling device 4, the fan 5 and the cooled air supply controller 6 are provided under the first partition 2. The cooled air generated by the cooling device 4 is circulated in the refrigerator main body 1 by the fan 5, and the cooled air is distributed to the refrigerating compartment 100 and the new temperature zone of freezer compartment 300 through the cooled air supply controller 6 provided beside the fan 5.

In this embodiment, the dead space can be minimized since the devices forming the cooling unit are collectively provided behind the freezer compartment and the new temperature zone of freezer compartment under the first partition. A middle size or less of refrigerator, which is convenient to families with few members, such as newly married couples and old persons, can be provided with a great volume in a compact size and, in particular, the refrigerating compartment with an available space extended in a depth direction.

The refrigerating compartment, which has the most frequent access by users, is provided at the upper position, the door is provided at a front side of the refrigerating compartment so as to be supported on one side, and the freezer compartment and the new temperature zone of freezer compartment are provided so as to include the drawable doors and the containers attached thereto movable in the front and rear directions with respect to the refrigerator. The users can open the door of the refrigerating compartment to take foods in and out of the refrigerating compartment without stooping. The users can shorten the time required to check the place of stored foods since the foods are right before their eyes. The users can take out foods from the new temperature zone of freezer compartment without crunching since the new temperature zone of freezer compartment, which has frequent access by the users next to the refrigerating compartment, includes the withdrawal door and the container attached thereto movable in the front and rear directions with respect to the refrigerator.

The freezer compartment 200 has a temperature detector 205 provided on, e.g., a top wall thereof, which controls the inside of the freezer compartment 200 by driving and halt the compressor 401 and the fan 5 so as to bring the detected temperature into a set temperature range.

The cooled air supply controller 6 is provided with two cooled air outlets and is provided so as to extend in the front and rear directions with respect to the refrigerator main body 1. The refrigerating compartment 100 has a refrigerating compartment temperature detector 103 provided therein, and the new temperature zone of freezer compartment 300 has a new temperature zone of freezer compartment temperature detector 303 provided therein. The cooled air, which is supplied by opening and closing the two cooled air outlets 7, 8 in the cooled air supply controller 6 so as to keep the detected temperatures in set temperature ranges for both compartments as stated later on, is fed to each of the refrigerating compartment 100 and the new temperature zone of freezer compartment 300 to cool both compartments.

Figure 11:
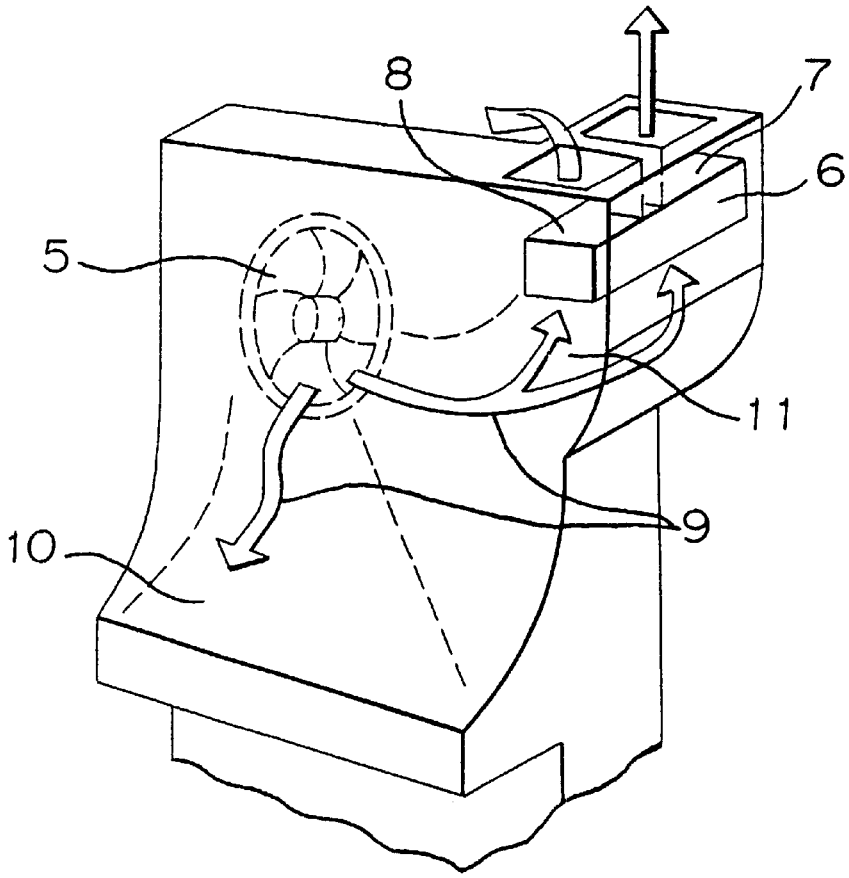
FIG. 11 is a schematic view of the fan and the cooled air supply controller according to the first embodiment.

Now, the paths in this embodiment will be described in detail, referring to the accompanying drawings. In FIG. 11 is shown an enlarged view of the fan 5 and the cooled air supply controller 6 according to this embodiment. In this figure, reference numeral 5 designates the fan 5, and reference numeral 6 designates the cooled air supply controller. Reference numeral 7 designates a cooled air outlet, which is formed in the cooled air supply controller 6 and is located on a rear side with respect to the refrigerator main body 1. Reference numeral 8 a cooled air outlet, which is formed in the cooled air supply controller 6 and is located on a front side with respect to the refrigerator main body 1. Reference numeral 9 designates cooled air, which is lo circulated in the refrigerator by the fan 5. Reference numeral 10 designates an air path for the freezer compartment, and reference numeral 11 designates an air path for the cooled air supply controller.

The cooled air 9 indicated by arrows is blown out of the fan 5 in a forward direction, and is distributed into the freezer compartment air path 10 provided downwardly and into the cooled air supply controller air path 11 provided be side the fan 5. The two cooled air outlets 7 and 8 are formed in the cooled air supply controller 6 on the front and rear sides with respect to the freezer compartment 1, and the rear cooled air outlet 7 and the front cooled air outlet 8 are connected to the refrigerating compartment 100 and the new temperature zone of freezer compartment 300, respectively.

Now, the structure of the cooled air supply controller will be described in detail, referring to the accompanying drawings.

Figure 12:
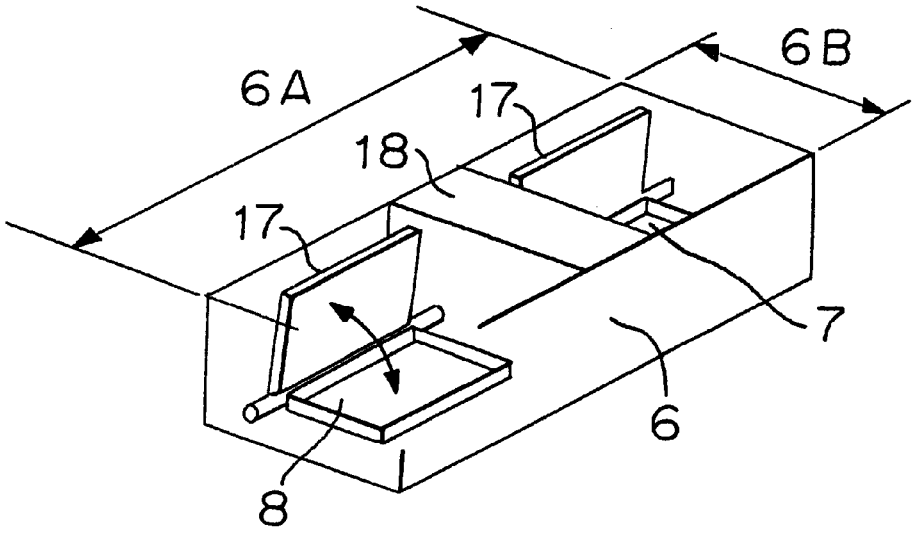
FIG. 12 is a detailed view of the cooled air supply controller according to the first embodiment.

In FIG. 12 is shown a schematic view of the cooled air supply controller 6 according to the first embodiment. In FIG. 12, reference numeral 17 designates baffles, which open and close the respective outlets 7, 8 of the cooled air supply controller 6. Reference numeral 18 designates a drive with an electric motor, which is provided between the outlets 7, 8 of the cooled air supply controller 6 to open and close the baffles 7. The total size 6A of the two outlets 7, 8 and the drive 18 is longer than the width size 6B of the drive 18 and the baffles 17.

Figure 13:
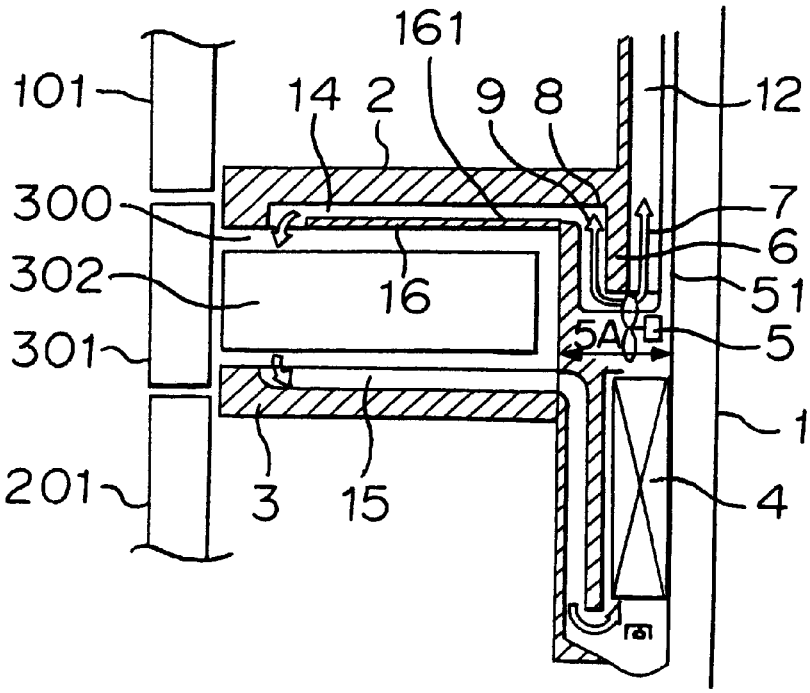
FIG. 13 is a cross-sectional view of an air path in the refrigerator according to the first embodiment.
Figure 14:
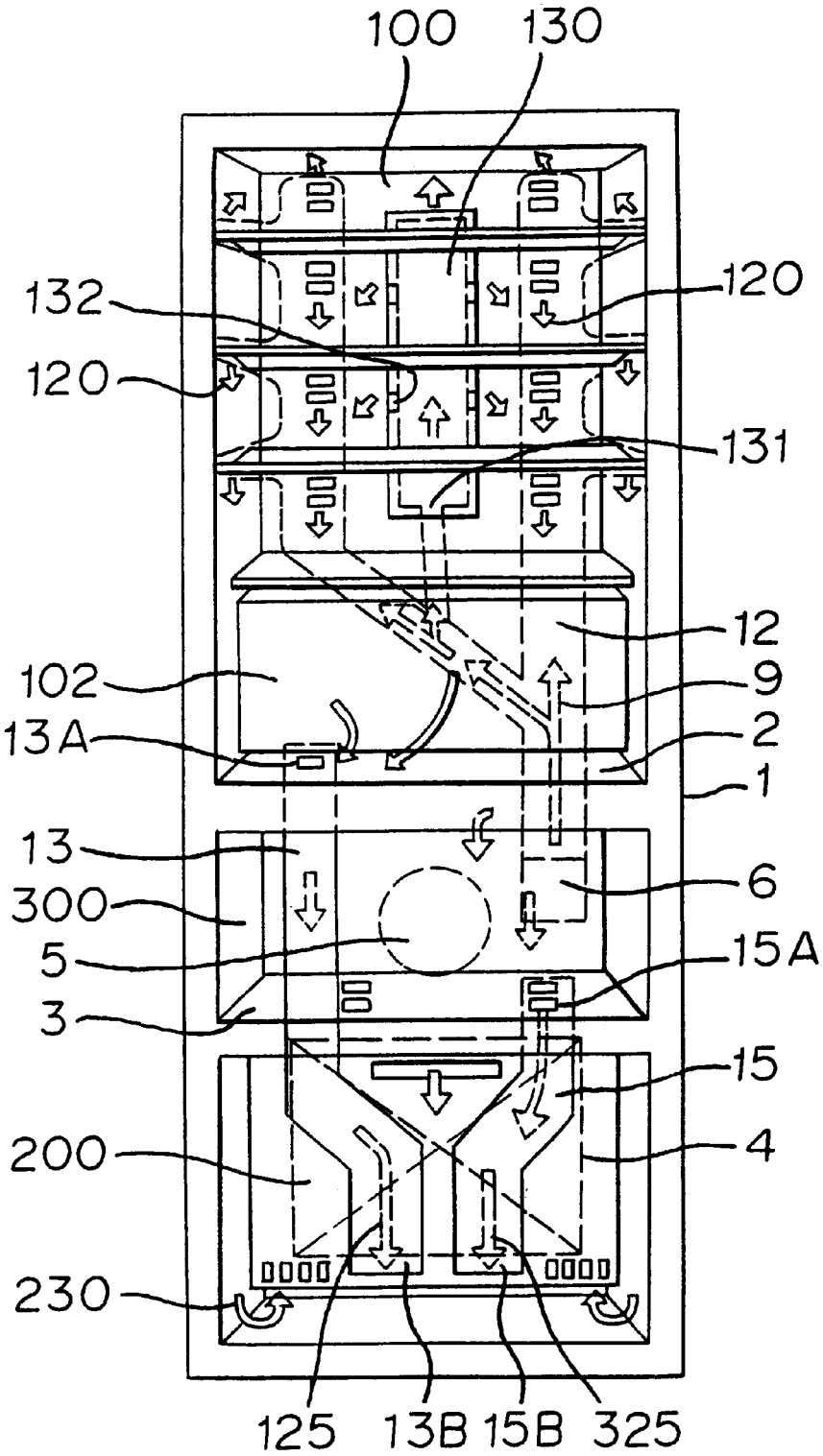
FIG. 14 is a cross-sectional view showing the air path arrangement for the new temperature zone of freezer compartment according to the first embodiment of the present invention.

In FIG. 13 is shown a cross-sectional view of the air path arrangement of the new temperature zone of freezer compartment according to the first embodiment. In FIG. 14 is shown a front view of the refrigerator main body 1 to show the air path arrangement according to the first embodiment. In FIGS. 13 and 14, reference numeral 1 designates the refrigerator main body, reference numeral 100 designates the refrigerating compartment, reference numeral 200 designates the freezer compartment, and reference numeral 300 designates the new temperature zone of freezer compartment. Reference numeral 2 designates the first partition, which is provided between the refrigerating compartment 100 and the new temperature zone of freezer compartment 300 and includes a heat insulating material. Reference numeral 3 designates the second partition, which is provided between the new temperature zone of freezer compartment 300 and the freezer compartment 200 and includes a heat insulating material.

Reference numeral 4 designates the cooling device, which is provided above the machine space 400 and behind the freezer compartment 200. Reference numeral 5 designates the fan, which is provided above the cooling device 4 and behind the new temperature zone of freezer compartment 300. Reference numeral 6 designates the lo cooled air supply controller. Reference numeral 7 designates the cooled air outlet, which is formed in the cooled air supply controller 6 and is located on the rear side with respect to the refrigerator main body 1.

Reference numeral 8 designates the cooled air outlet, which is formed in the cooled air supply controller 6 and is located on the front side with respect to the refrigerator main body 1. Reference numeral 9 designates the cooled air, which is circulated in the refrigerator.

Reference numeral 10 designates the freezer compartment air path, and reference numeral 11 designates the cooled air supply controller air path.

Reference numeral 12 designates an air path for the refrigerating compartment, which is provided behind the refrigerating compartment 100. Reference numeral 13 designates a return air path for the refrigerating compartment, which is formed in the first partition 2 forming a bottom wall of the refrigerating compartment 100. Reference numeral 13A designates an inlet of the return air path for the refrigerating compartment, which is provided on the top of the return air path 13 for the refrigerating compartment. Reference numeral 13B designates an outlet of the return air path for the refrigerating compartment, which is provided at the bottom of the return air path 13 for the refrigerating compartment. Reference numeral 14 designates an outlet air path for the new temperature zone of freezer compartment, which is provided in the first partition 2. Reference numeral 15 designates a return air path for the new temperature zone of freezer compartment, which is provided in the second partition 3 forming the bottom wall of the new temperature zone of freezer compartment 300. Reference numeral 15A designates an inlet of the return air path for the new temperature zone of freezer compartment, which is provided at the top of the return air path 15 for the new temperature zone of freezer compartment. Reference numeral 15B designates an outlet of the return air path for the new temperature zone of freezer compartment, which is provided on the bottom of the return air path 15 for the new temperature zone of freezer compartment.

Reference numeral 130 designates a lamp cover, which houses a lamp to illuminate the inside of the refrigerating compartment. Reference numeral 131 designates a cooled air inlet, which is provided at a lower portion of the lamp cover 130. Reference numeral 132 designates a cooled air outlet, which is provided at plural locations on sides and an upper portion of the lamp cover 130.

The cooled air 9, which is generated by the cooling device 4, is circulated in the refrigerator main body 1 by the fan 5, and the cooled air is distributed into the refrigerating compartment 100 and the new temperature zone of freezer compartment 300 through the cooled air supply controller 6 provided beside the fan 5.

The cooled air 9, which has passed through the outlet 7 for the refrigerating compartment, passes through the partition 2 and is supplied into the cooled air outlet air path 12 for the refrigerating compartment behind the refrigerating compartment 100. Then, the cooled air cools the refrigerating compartment 100 by being blown out of cooled air outlets 120, which are provided on at least one of the rear wall, the right side wall, the left side wall and the top wall of the refrigerating compartment. A portion of the cooled air, which is branched from the cooled air outlet air path 12 for the refrigerating compartment, is sucked into the lamp cover 130 through the cooled air inlet at the lower portion of the lamp cover 130, and is blown into the refrigerating compartment 100 from the cooled air outlet at plural locations on the sides and the top of the lamp cover 130 to cool the inside of the refrigerating compartment 100. The cooled air 9 that has been blown out into the refrigerating compartment 100 cools an upper portion in the refrigerating compartment and a door shelf, and is sucked into the return air path 13 for the refrigerating compartment provided in the second partition 2 forming the bottom wall of the refrigerating compartment 100. The container 102, which is provided at the lower portion in the refrigerating compartment 100 to preserve vegetables and other groceries can maintain a higher temperature than the upper portion in the refrigerating compartment since the container is cooled by the descended cooled air.

Referring now to FIG. 13, the cooled air 9 that has passed through the outlet 8 for the new temperature zone of freezer compartment is supplied into the outlet air path 14 for the new temperature zone of freezer compartment provided in the second partition 2. After the cooled air has cooled the new temperature zone of freezer compartment 300, the cooled air is sucked into the return air path 15 provided in the second partition 3 forming the bottom wall of the new temperature zone of freezer compartment 300. Between the outlet air path 14 for the new temperature zone of freezer compartment and the new temperature zone of freezer compartment 300 is provided a heat insulating material 16.

The distance 5A shown in FIG. 13, which is a length between a rear wall surface 51 of the refrigerator main body 1 behind the fan 5 and an end surface 161 of the heat insulating material 16 of the new temperature zone of freezer compartment 300 near a front end of the fan 5, is longer than the longitudinal size 6A of the cooled air supply controller 6 (FIG. 12). In order to prevent the volume in the new temperature zone of freezer compartment 300 from decreasing, the cooled air supply controller 6 is provided so as to have the longitudinal length 6A extended in the depth direction with respect to the refrigerator main body 1, that is to say, to have the two outlets 7, 8 aligned in the front and rear directions. In other words, the air path arrangement can become compact in terms of the width direction of the refrigerator main body 1 since the cooled air supply controller 6 is provided beside the fan 5 so as to have the smaller length 6B extended in the width direction as shown in FIG. 14.

As explained, the two cooled air outlets 7, 8 of the cooled air supply controller 6 can be aligned in the front and rear directions with respect to the refrigerator main body 1 to reduce the width of the cooling unit. Thus, a middle size or less of compact refrigerator having a small width (a width size of about 600 mm), which is convenient to families with few members, such as newly married couples and old persons, can be provided with an easy-to-use new temperature zone of freezer compartment.

The cooled air supply controller 6 has the rear outlet 7 assigned to the refrigerating compartment. The air path 12 to the refrigerating compartment, which is provided behind the refrigerating compartment, can be provided in a thinner size since the air path extends along the rear wall of the refrigerating compartment to be connected to the rear outlet 7 of the cooled air supply controller 6. A middle size or less of refrigerator, which is convenient to families with few members, such as newly married couples and old persons, can be provided with a great volume in a compact size and with the refrigerating compartment with an available space extended in a depth direction.

The top surface of the new temperature zone of freezer compartment 300 can be prevented from being dewed or frosted since the heat insulating material 16 is provided between the new temperature zone of freezer compartment 300 and the outlet air path 14 for the new temperature zone of freezer compartment.

Although the cooled air supply controller for the. refrigerating compartment has been provided at a lower portion of and behind the refrigerating compartment in the prior art, the cooled air supply controller 6 is provided behind the new temperature zone of freezer compartment 300 in this embodiment. In accordance with this embodiment, the size in the depth direction can be set to be shorter than the shorter width size 6B of the cooled air supply controller 6 since only the air path is provided behind the refrigerating compartment 100. Thus, the outlet air path 12 for the refrigerating compartment can be thinner in comparison with the conventional one to enlarge the volume in the refrigerating compartment 100. The container 102, which is provided at a lower portion in the refrigerating compartment 100 to preserve vegetables and other groceries, can have the rear wall extended to a deeper location than the rear wall of the container 302 of the new temperature zone of freezer compartment 300, and the container 102 can preserve vegetables and other groceries in a greater capacity.

A portion of the cooled air, which is branched from the outlet air path 12 for the refrigerating compartment, is sucked into the lamp cover 130 through the lower inlet of the lamp cover 130 is blown out into the refrigerating compartment 100 through the cooled air outlet formed on the sides and the top of the lamp cover 130, and the blown air cools the inside of the refrigerating compartment 100. Thus, the lamp in the lamp cover 130 can also be cooled. In addition, the number of the cooled air outlets into the refrigerating compartment 100 can be increased by the number of the outlets formed in the lamp cover 130 to uniformly to the inside of the refrigerating compartment 100, improving a temperature distribution.

Referring now to FIG. 14, the inlet 13A of the return air path 13 for the refrigerating compartment is located at a first lateral position with respect to the central longitudinal axis of the cooling device 4, and the inlet 15A of the return air path 15 for the new temperature zone of freezer compartment is located at a second lateral position opposite to the inlet 13A of the return air path 13 for the refrigerating compartment with respect to the central longitudinal axis of the cooling device. Behind the freezer compartment 200, the return air path 13 for the refrigerating compartment and the return air path 15 for the new temperature zone of freezer compartment are extended toward the central longitudinal axis of the cooling device 4, and the outlet 13B of the return air path 13 for the refrigerating compartment and the outlet 15B of the return air path 15 for the new temperature zone of freezer compartment are provided in the vicinity of the central longitudinal axis of the cooling device 4. Cooled air 125 returned from the refrigerating compartment and cooled air 325 returned from the new temperature zone of freezer compartment are sucked in the vicinity of a central lower potion of the cooling device 4.

Cooled air 230 that is returned after having cooled the freezer compartment 200 is sucked at lower outer positions farther from the outlet 13B of the return air path 13 for the refrigerating compartment and the outlet 15B of the return air path 15 for the new temperature zone of freezer compartment with respect to the central longitudinal axis of the cooling device 4. If the cooled air 125 returned from the refrigerating compartment 100 and the cooled air 325 returned from the new temperature zone of freezer compartment 300, which are more humid than the cooled air 230 returned from the freezer compartment 200, is sucked at positions outwardly far from the central longitudinal axis of the cooling device 4, frost starts to be deposited on the outer positions of the cooling device 4, and the frost becomes hardened in the vicinity of the outer edges of the cooling device 4, lowering cooling capacity because of difficulty in melt in some cases.

In accordance with this embodiment, the return cooled air 125 from the refrigerating compartment 100 and the returned cooled air 325 from the new temperature zone of freezer compartment 300, which are more humid than the returned cooled air from the freezer compartment 200, can be sucked in the vicinity of a lower central portion of the cooling device 4 with respect to the central longitudinal axis thereof to grow the frost from a central position of the cooling device 4, preventing the cooling capacity from lowering because of difficulty in the melt of hardened frost.

Thus, the frost can be uniformly deposited to mitigate a decrease in the cooling capacity by the deposition of the frost. Although, in this embodiment, the returned cooled air 125 from the refrigerating compartment 100, the returned cooled air 325 from the new temperature zone of freezer compartment 300 and the returned cooled air 230 from the freezer compartment 200 are suck in the vicinity of the lower central portion of the cooling device 4 with respect to the central longitudinal axis thereof, the sucking position is not limited to the vicinity of the lower portion. The sucking position may be the vicinity of an upper portion of the cooling device as long as suction and outlet can be carried out without trouble.

EMBODIMENT 2

Figure 15:
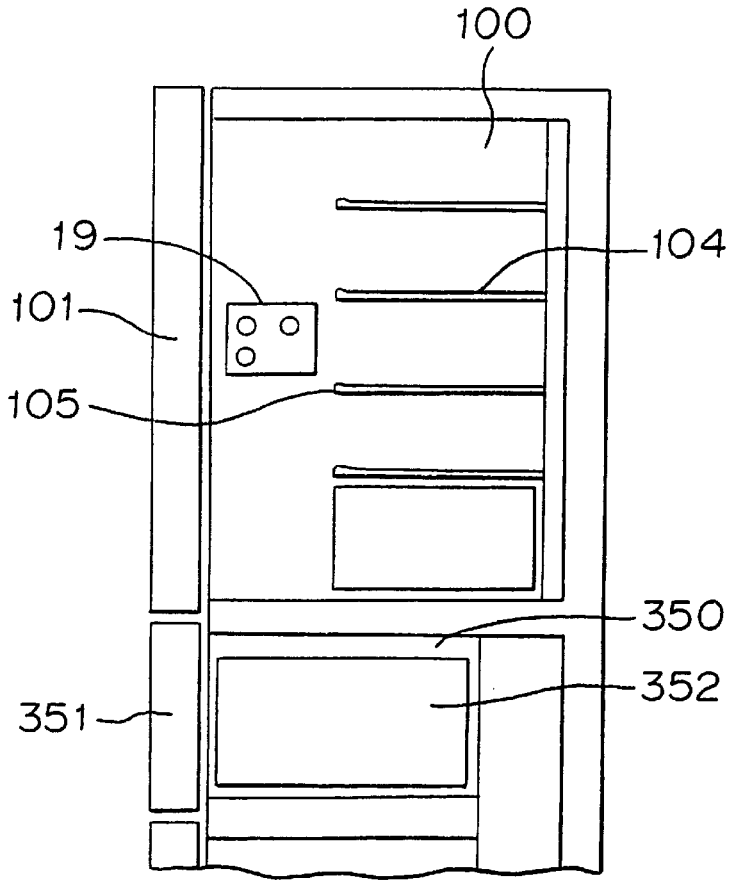
FIG. 15 is a cross-sectional side view of the refrigerating compartment according to a second embodiment of the present invention.
Figure 16:
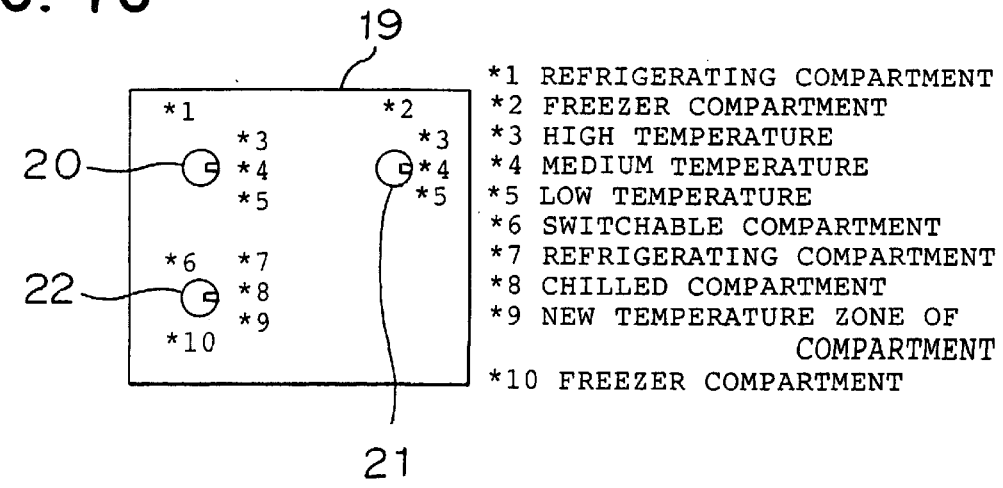
FIG. 16 is a detailed schematic view of the temperature controller provided in the refrigerating compartment shown in FIG. 15.

In FIG. 15 is shown a cross-sectional side view of the refrigerator according to a second embodiment of the present invention. In FIG. 16 is shown a detailed schematic view of the temperature controller shown in FIG. 15. In these Figures, reference numeral 19 designates the temperature controller, reference numeral 104 designates shelves for storing foods provided at plural levels in the refrigerating compartment 100, and reference numeral 105 designates the front end of a shelf 104 for storing foods. Reference numeral 350 designates a switchable compartment, which is provided between the refrigerating compartment 100 provided at the upper position in the refrigerator main body 1 and the freezer compartment 200 provided at the lower position in the refrigerator main body. Reference numeral 352 designates a container, which is slidable along with a drawable door 351 in the front and rear directions. The temperature controller 19 includes a refrigerating compartment dial 20, a freezer compartment dial 21 and a switchable compartment dial 22, which a user can set at a desired position to modify the set temperatures in the respective compartments in an air path arrangement similar to that shown in the first embodiment.

In these figures, the temperature controller 19 is provided at a front side on a side wall in the refrigerating compartment 100. When the temperature controller is provided at a position located at a height of, for instance, not lower than 1000 mm and not higher than 1500 mm in the refrigerator main body 1. A user can visually check the stored foods and take foods in and out of the refrigerator in a natural posture without his or her stooping, or without a short woman's or an old person's standing on tiptoe.

In these Figures, the temperature controller 19 is provided at a height between adjoining shelves 104 and at a position forwardly of the front end 105 of a shelf 104 with foods carried thereon. A user can visually check the set positions of the dials 20, 21 and 22 and set the rotary positions of the dials to carry out set temperature modifications easily without preventing access to the temperature controller 19 from being interfered by stored foods even if the foods are fully carried on the shelf 104.

The dials 20, 21 and 22 for the respective compartments on the temperature controller 19 may be arranged in a vertical alignment or a horizontal alignment. As shown in FIG. 15, two of the dials may be arranged on a front side and the remaining dial may be arranged on a rear side to accept a large size of dials, improving operability in the limited space between the adjacent shelves. In this case, the temperature controller 19 can be provided with good operability by arranging the refrigerating compartment dial 20 and the switchable compartment 22 having frequent access by a user on the front side and the freezer compartment dial 21 on the rear side.

By changing the setting of the switchable compartment dial 22, the set temperature in the switchable compartment 350 can be changed to a freezer compartment temperature (−20° C. to −18° C.), anew temperature zone of freezer compartment temperature (−9° C. to −5° C.), a refrigerating compartment temperature (3° C. to 5° C.), an icing temperature compartment temperature (−3° C. to 0° C.) and a vegetable compartment temperature or a wine compartment temperature (5° C. to 10° C.) as required.

Thus, the switchable compartment can be used as a compartment controllably set to the freezer compartment temperature, the new temperature zone of freezer compartment temperature, the refrigerating compartment temperature, the icing temperature compartment temperature and the vegetable or wine compartment temperature to provide a convenient-to-use and practical-to-use refrigerator to families with few members, such as newly married couples and old persons.

EMBODIMENT 3

Figure 17:
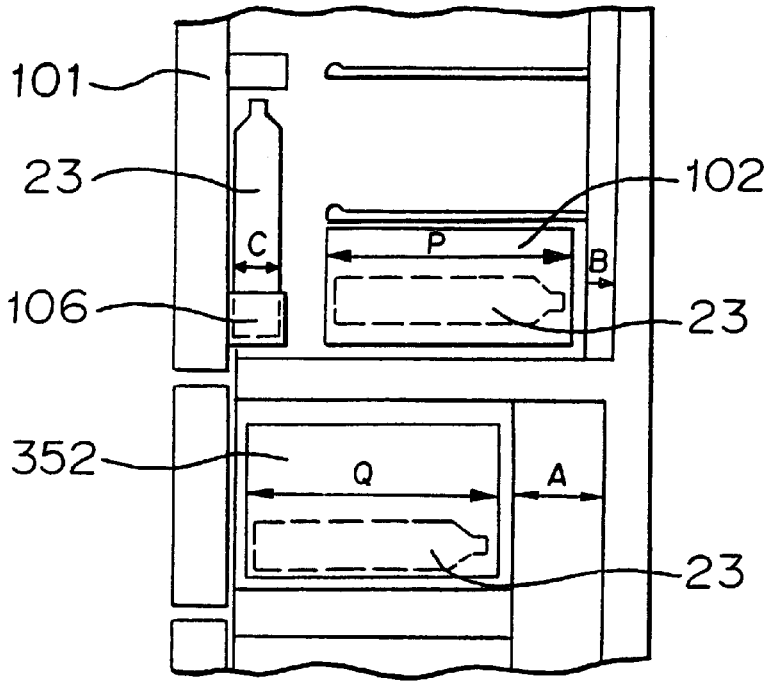
FIG. 17 is a cross-sectional side view of a portion of the refrigerator according to a third embodiment of the present invention.

In FIG. 17 is shown a cross-sectional side view of the refrigerator according to the third embodiment of the present invention as one example of storage. In this Figure, reference numeral 100 designates the refrigerating compartment, and reference numeral 102 designates the container, which is provided at the lower portion in the refrigerating compartment 100 to preserve vegetable and other groceries. Reference numeral 101 designates the door provided on the front side of the refrigerating compartment 100. Reference numeral 106 designates a door shelf provided on the door 101. Reference numeral 352 designates the container provided in the switchable compartment 350. The door shelf 106 has a width size C set to store a 1.5 l of PET bottle (polyethylene terephthalate bottle) 23 and another article in a vertical position.

The depth size A of the housing space for the fan 5 and the cooled air supply controller 6 and the depth size B of the freezer compartment outlet air path are determined so as to satisfy the relationship of $A \approx B+C$. As a result, the depth size P of the container 102 for preserving vegetables and other groceries and the depth size Q of the container 352 in the switchable compartment 350 can have substantially the same size, storing 1.5 l of PET bottles 23 in a horizontal position in both of the container 102 for preserving vegetables and other groceries and for the container 352, for instance.

In the refrigerator according to the present invention, the container for preserving vegetables and other groceries, which has a higher temperature zone different from the temperature zone in the refrigerating compartment, is provided at the lower position in the refrigerating compartment so as to be slidable in the front and rear directions with respect to the refrigerator. In addition, the rear wall of the container is located at a position backwardly of the rear wall of the container in the new temperature zone of freezer compartment. This arrangement can provide a refrigerator, which is easy to use and has the container for preserving vegetables and other groceries in a great storage volume.

The container 102 for preserving vegetables and other groceries and the container 352 in the switchable compartment can have substantially the same depth size to make parts compatible for both containers. Thus, compatible parts can be used to produce a plurality of preserving spaces to reduce the cost because of the compatibility of parts.

EMBODIMENT 4

Figure 18:
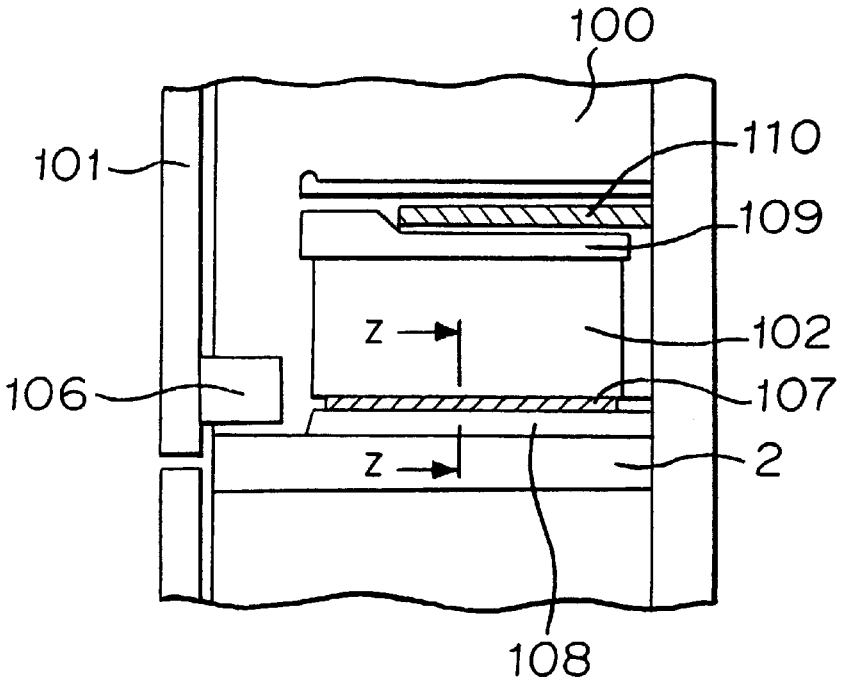
FIG. 18 is a cross-sectional side view of the container for preserving vegetables and other groceries and its surroundings according to a fourth embodiment of the present invention.
Figure 19:
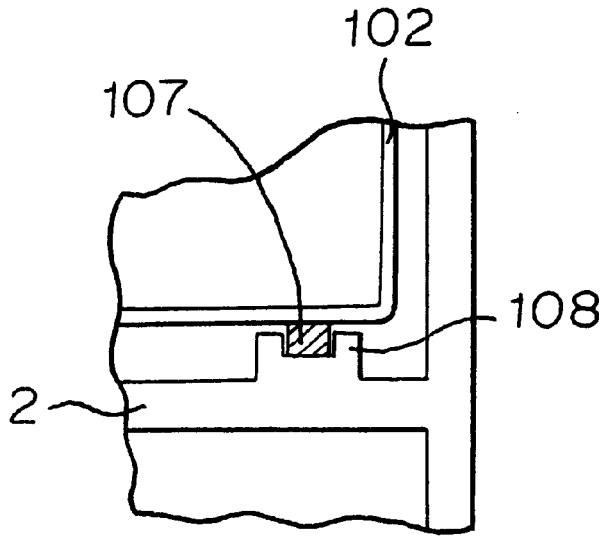
FIG. 19 is a cross-sectional side view take along the line Z—Z of FIG. 18 to show a rail structure under the container.
Figure 20:
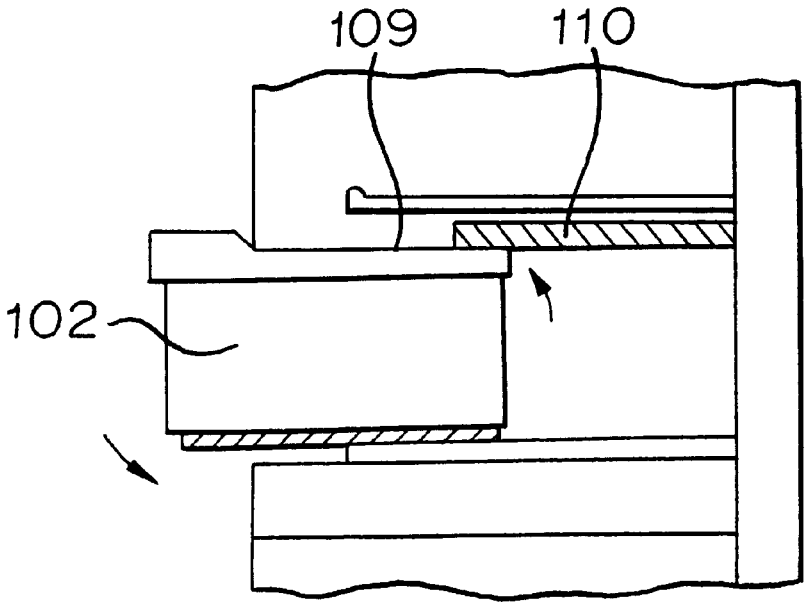
FIG. 20 is a cross-sectional side view of the container and its surroundings when the container is drawn out, in the fourth embodiment.

A fourth embodiment according to the present invention will be described, referring to FIGS. 18, 19, 20 and 21. In FIG. 18 is shown a schematic view of a container 102 for preserving vegetables and other groceries and its surroundings in a lower portion of the refrigerating compartment. FIG. 19 is a sectional view taken along the line Z—Z of FIG. 18 to explain an rail structure, which is provided under the container at the lower portion in the refrigerating compartment. In FIG. 20 is shown a cross-sectional view of a part of the refrigerator main body, wherein the container for preserving vegetables and other groceries is drawn out.

In these Figures, reference numeral 101 designates the door provided on the front side of the refrigerating compartment 100, and reference numeral 102 designates the container for preserving vegetables and other groceries, which are provided at the lower portion in the refrigerating compartment 100. Reference numeral 106 designates the door shelf provided on the door 101. Reference numeral 107 designates convex sliders, which are provided on the lower surface of the container for preserving vegetables and other groceries, and which are located at two positions on right and left side of the container 102. Reference numeral 108 designates concave rails, which are provided on the partition 2 forming the bottom wall of the refrigerating compartment 100, and which receive the convex sliders 107 on the container 102 so as to slidably support the container 102 in the front and rear directions with respect to the refrigerator main body 1. The rails 108 have front ends located at substantially the same position as the front end of the container 102 for preserving vegetables and other groceries, preventing interference with the door shelf 106.

The container 102 for preserving vegetables and other groceries has top side edges formed with reinforcing members 109, and tumble preventing members 110 are provided above positions facing to the reinforcing members 109. When the container 102 is forwardly drawn out with respect to the refrigerator main body 1 to take an article of food in or out as shown in FIG. 20, the front portion of the container 102 gets out of the rails 108, and the container tends to slant forwardly by gravity. At that time, the reinforcing members 109 of the container 102 can contact the tumble preventing members 110 to prevent the container 102 from slanting, and can carry out a smooth slide.

Figure 21:
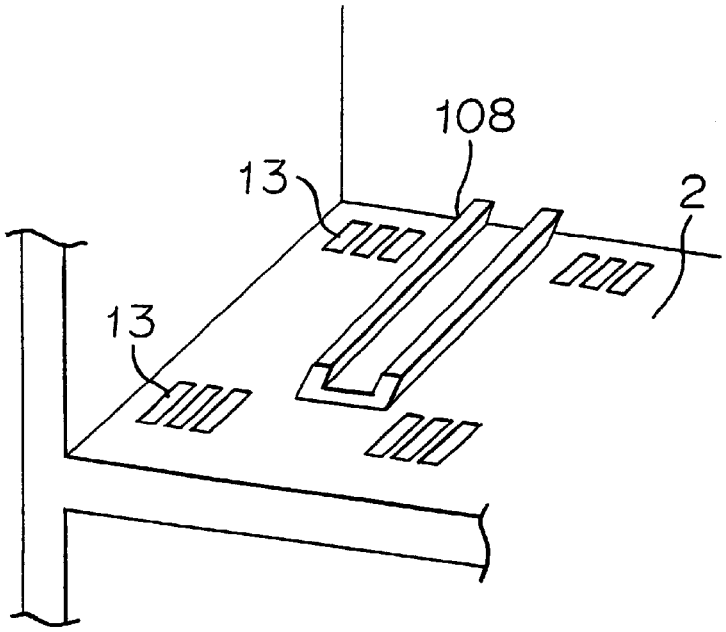
FIG. 21 is a perspective view of the container and its surroundings according to the fourth embodiment.

In FIG. 21 is shown a perspective view of the slider structure for the container and its surroundings in the refrigerator main body. In FIG. 21, reference numeral 108 designates a concave rail, reference numeral 2 designates the partition forming the bottom wall of the refrigerating compartment 100, and reference numeral 13 designates the cooled air return air path for the refrigerating compartment 100. The cooled air return air path 13 for the refrigerating compartment is provided in the partition 2 forming the bottom wall of the refrigerating compartment 100, and the cooled air return air path 13 for the refrigerating compartment has openings located laterally of the rails 108 and their extensions without having the openings located in the rails or their extensions.

Since the openings of the return air path 13 for the refrigerating compartment are not located in the rails 108 or their extensions but located laterally of the rails and their extensions, scraps of food, such as vegetables, or drops of water, which have dropped on a rail 108 with the container 102 drawn out, is prevented from being caught and dropped into the return air path 13 for the refrigerating compartment, in the sliding movement of the container 102, by the convex sliders 107, which are provided at two locations on the lower surface of the container 102.

EMBODIMENT 5

Figure 22:
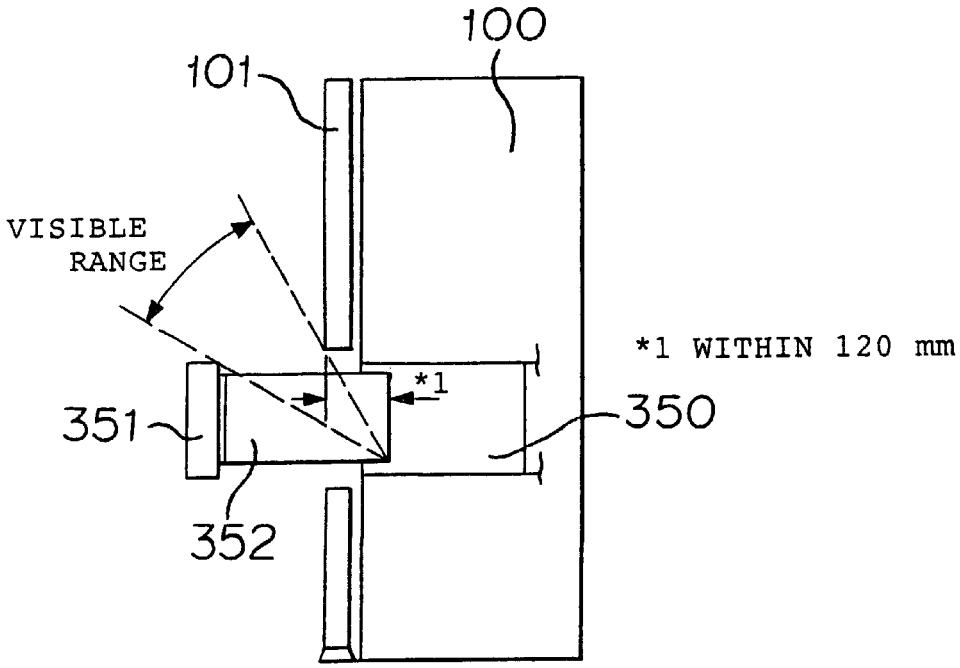
FIG. 22 is a cross-sectional side view of the refrigerator according to a fifth embodiment of the present invention.

In FIG. 22 is shown a cross-sectional side view of a fifth embodiment according to the present invention, wherein the switchable compartment (or the new temperature zone of freezer compartment) is drawn out. In this Figure, reference numeral 101 designates the door provided on the front side of the refrigerating compartment, reference numeral 350 designates the switchable compartment, reference numeral 351 designates the drawable door provided on the front side of the switchable compartment 350, and reference numeral 352 designates the container provided in the switchable compartment 350.

In this Figure, the container 352 has such a length that the container can be supported at a portion thereof between the rear wall of the container 352 and the front end surface of the door 101 having a horizontal distance of not greater than 120 mm with the switchable compartment 350 drawn out to the full.

As a result, the container can be provided with excellent visibility since a user can easily survey even the deepest position in the container 352 without stooping. The improved visibility offers advantages in that not only taking articles of foods in and out is facilitated, but also the opened time of the drawable door 351 of the switchable compartment 350 is shortened to minimize a rise in temperature in the switchable compartment caused by the opened drawable door 351.

EMBODIMENT 6

Figure 23:
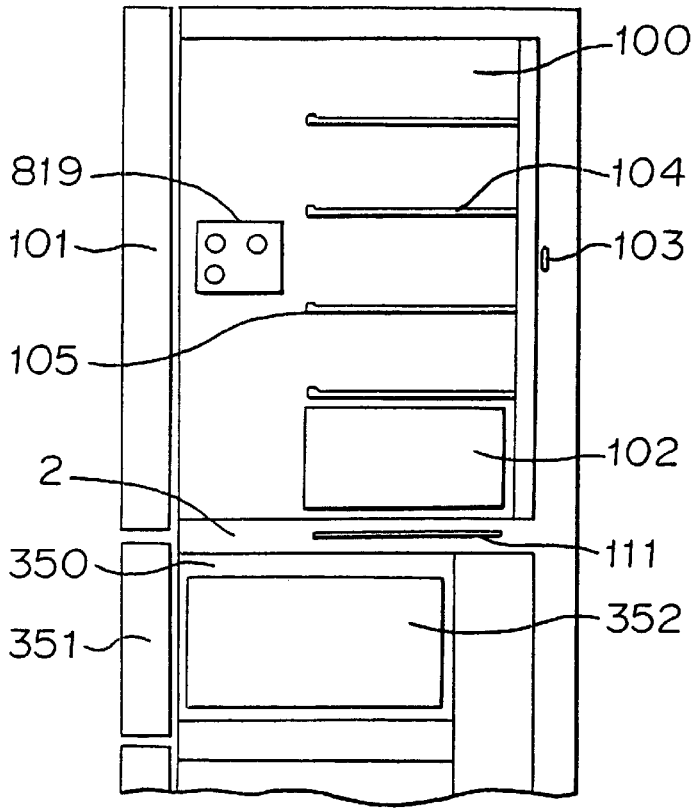
FIG. 23 is a cross-sectional side view of the refrigerator according to a sixth embodiment of the present invention.
Figure 24:
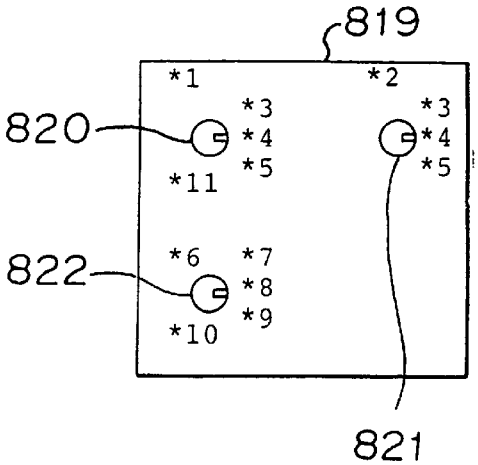
FIG. 24 is a detailed schematic view of the temperature controller provided on the refrigerator shown in FIG. 23.

In FIG. 23 is shown a cross-sectional side view of the refrigerator according to a sixth embodiment of the present invention. In FIG. 24 is shown a detailed schematic view of the temperature controller shown in FIG. 23. In these Figures, reference numeral 819 designates the temperature controller, which is provided at a front position on a side wall in the refrigerating compartment 100. The temperature controller 819 includes a refrigerating compartment dial 820, a freezer compartment dial 821 and a switchable compartment dial 822, which a user can set at a desired position to modify the set temperatures in the respective compartments. Reference numeral 100 designates the refrigerating compartment, and the reference numeral 102 designates the container for preserving vegetables and other groceries, provided at the lower portion in the refrigerating compartment. Reference numeral 103 designates the temperature sensor for the refrigerating compartment, which is provided on the rear wall of the refrigerating compartment. Reference numeral 111 designates a heater, which is provided in the partition 2 under the container for preserving vegetables and other groceries and located at a position close to the container.

As shown in FIG. 24, the refrigerating compartment dial 820 has an icing temperature level added to usual low temperature, medium temperature and high temperature levels. When the refrigerating compartment dial 820 is set at a desired temperature, the temperature in the refrigerating compartment 100 is controlled to be in the icing temperature zone (−3° C. to 1° C.) by opening and closing the refrigerating compartment outlet of the cooled air supply controller 6 so as to conform the temperature detected by the refrigerating compartment temperature sensor 103 to the set desired temperature.

For the past, there has been raised a problem in that the temperature in the container 102 for preserving vegetables and other groceries is lowered too much since the inside of the container is cooled by the cooled air that has been cooled portions above the container in the refrigerating compartment 100. In this embodiment, the heater 111 is provided in the partition 2 under the container 102. When the refrigerating compartment dial 20 is set at the ice temperature, the heater 111 can be energized to maintain the temperature of the container 102 at a temperature of not lower than 0° C. to prevent stored foods from being iced. The energizing rate of the heater 111 may be set, depending on a set temperature for the refrigerating compartment and the ambient temperature about the refrigerator.

If the switchable compartment 350 is set to the new temperature zone (−9° C. to −5° C.), it has been difficult to preserve foods to be eaten within one week, such as sashimi or raw fish since it is impossible to preserve foods in the icing temperature zone (−3° C. to 0° C.). In this embodiment, the refrigerating compartment 100 can be set not only to the refrigerating compartment temperature (1° C. to 5° C.) but also to the icing temperature zone (−3° C. to 0° C.). Even if the switchable compartment 300 is used as the new temperature zone of freezer compartment, foods can be preserved in the icing temperature zone in the refrigerating compartment 100 to improve the convenience in food preservation by a user, providing a refrigerator with various use and convenience in use.

EMBODIMENT 7

Figure 25:
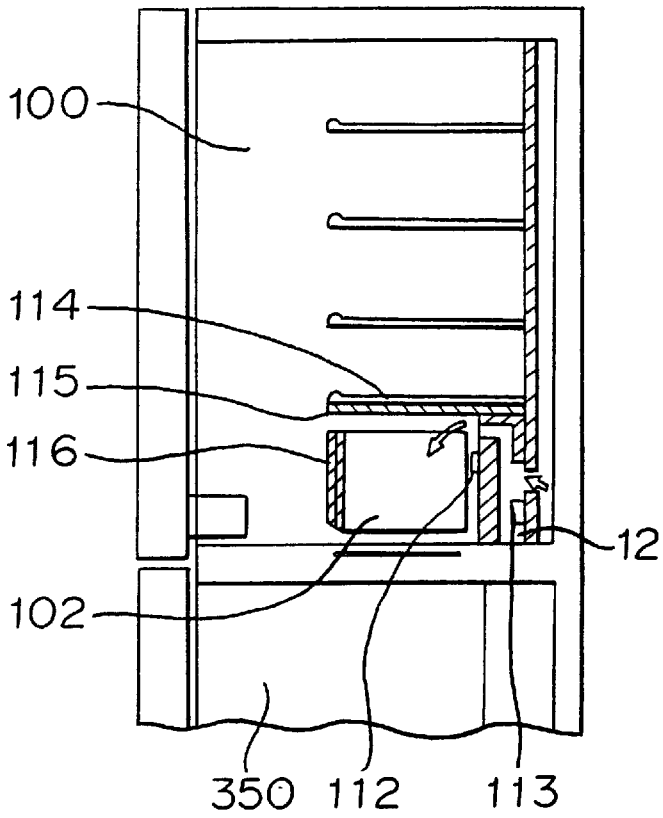
FIG. 25 is a cross-sectional side view of the refrigerator according to a seventh embodiment of the present invention.
Figure 26:
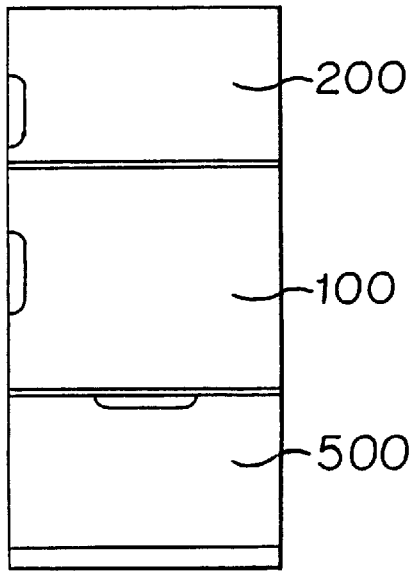
FIG. 26 is a front view of a conventional top freezer type refrigerator.
Figure 27:
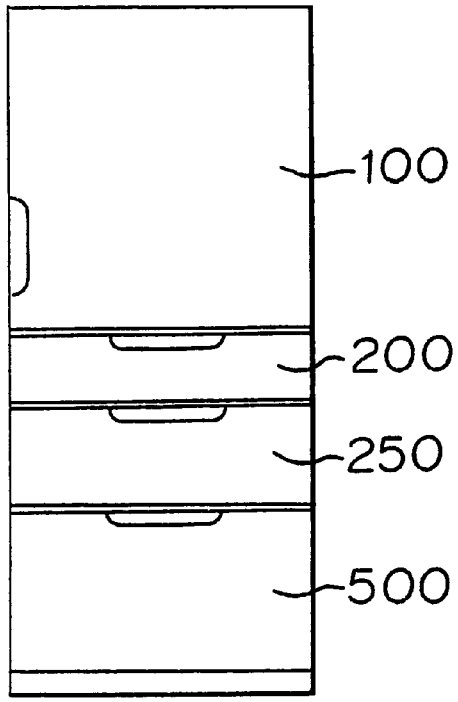
FIG. 27 is a front view of a conventional mid-freezer type refrigerator.
Figure 28:
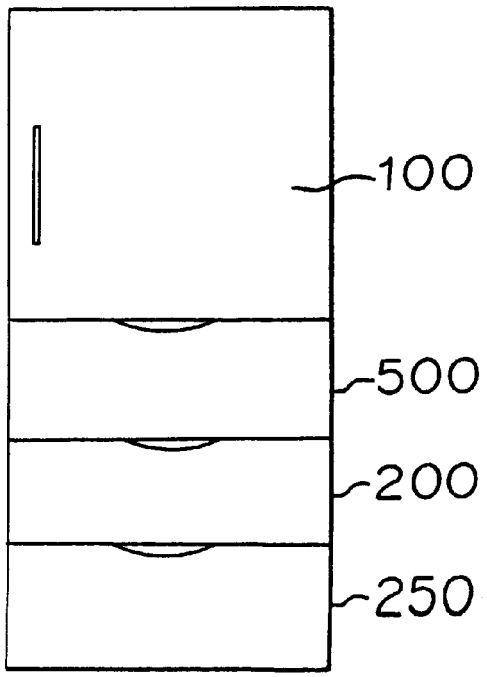
FIG. 28 is a front view of a conventional middle vegetable compartment type refrigerator.
Figure 29:
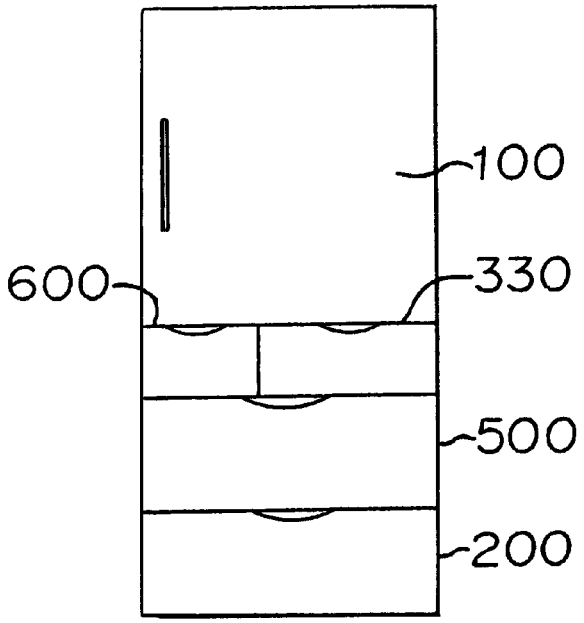
FIG. 29 is a front view of a conventional select type refrigerator.
Figure 30:
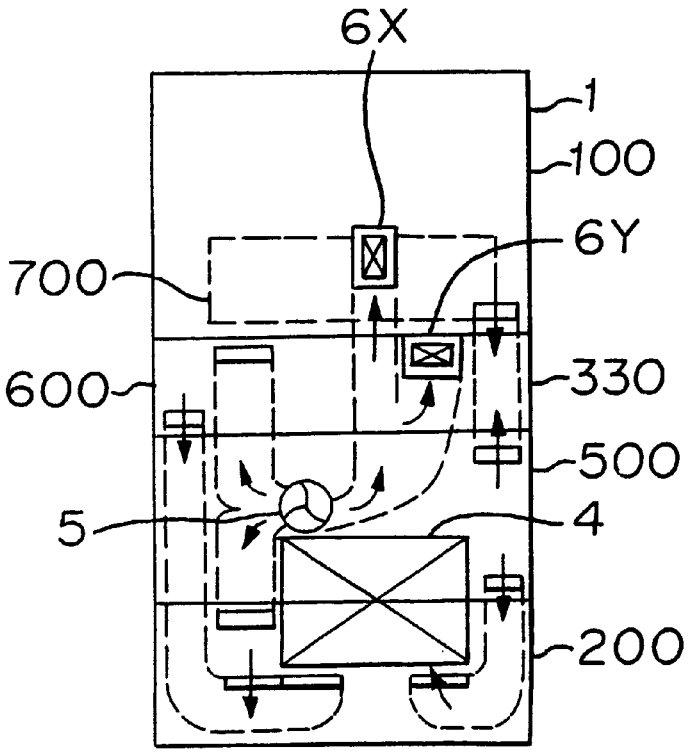
FIG. 30 is a schematic view showing the air path arrangement of a conventional refrigerator including the new temperature zone of freezer compartment.

In FIG. 25 is shown a cross-sectional side view of the refrigerating compartment according to a seventh embodiment of the present invention. In this Figure, reference numeral 102 designates a container provided at a lower portion in the refrigerating compartment 100, and reference numeral 12 designates a cooled air outlet air path for the refrigerating compartment behind the container 102. Reference numeral 112 designates a temperature sensor, which is provided on an outer wall of the outlet air path 12. Reference numeral 113 designates a cooled air supply controller, which is provided on an inner wall of the outlet air path 12. Reference numeral 114 designates the lowest shelf in the refrigerating compartment 100, which works as the top wall of the container 102. Reference numeral 115 designates a heat insulating layer, which is provided on a lower surface of the shelf 114. Reference numeral 116 designates a second heat insulating layer, which is provided on a front surface of the container 102.

As shown in FIG. 25, in the refrigerator according to this embodiment, the temperature sensor 112 is provided on the outer wall of the cooled air path 12, the cooled air supply controller 113 is provided in the outlet air path 12, and the temperature in the container 102 is controlled independently of the other portions in the refrigerating compartment so as to be switchable to the new temperature zone temperature or at least one of the freezer compartment temperature, the icing temperature, the refrigerating compartment temperature, the vegetable compartment temperature and the wine preserving compartment temperature. In particular, considering a case wherein the container can be set to the freezer compartment temperature or the new temperature zone of freezer compartment temperature, the heat insulating layer 115 is provided on the lowest shelf 114 as the top wall of the container 102, and the second heat insulating layer 116 is also provided on the front surface of the container 102.

In the case of a conventional refrigerator wherein the container 102 at the lower position in the refrigerating compartment 100 can be set only as the container for preserving vegetables and groceries, when the switchable compartment 350 is set to the new temperature zone (−9° C. to −5° C.), there has been raised a problem in that it is impossible to store foods to be preserved in the icing temperature zone (−3° C. to 0° C.). When the refrigerating compartment 100 except for the container 102 is set to the icing temperature, there has been raised a problem in storage of foods (such as soybean cakes) suited to preservation in the refrigerating temperature zone.

In accordance with this embodiment, the temperature in the container 102 can be controlled independently of other positions in the refrigerating compartment. The container can be maintained at a desired temperature without being affected by a change in temperature in the refrigerating compartment. The temperature in the container 102 can be switched to the new temperature zone of freezer compartment temperature or at least one of the freezer compartment temperature, the icing temperature compartment temperature, the refrigerating compartment temperature, the vegetable compartment temperature and the wine preserving compartment temperature. Not only the drawable switchable compartment but also the container in the refrigerating compartment can be set to any one of these temperatures, providing a middle size or less of refrigerator, which can have further improved convenience in food storage and can have wide selection of temperatures to provide various usages for food storage.

Even when the temperature in the container 102 is set at the freezer compartment temperature or the new temperature zone of freezer compartment temperature, the provision of the heat insulating layer 115 on the shelf 114 as the top wall of the container 102 and the provision of the second heat insulating layer 116 on the front surface of the container 102 can prevent the container 102 and the shelf 114 from being dewed by a temperature difference between outside and inside the countainer 102.

What is claimed is:

1. A refrigerator with a freezer compartment, comprising:

a refrigerating compartment provided at an upper position therein;

a freezer compartment provided at a lower position therein; and a new temperature zone of freezer compartment or a switchable compartment provided between the refrigerating compartment and the freezer compartment therein, the new temperature zone of freezer compartment working as a compartment having a new temperature zone of not higher than a maximum ice forming temperature zone and higher than a freezing temperature zone, and a temperature set to a temperature that foods preserved in the new temperature zone of freezer compartment can be cut without being thawed; and the switchable compartment being a compartment switchable to at least one of the new temperature zone, the freezing temperature zone, an ice forming temperature zone, a refrigerating temperature zone, a vegetable compartment temperature zone, and a wine preserving temperature zone;

wherein the new temperature zone of freezer compartment or the switchable compartment occupies substantially an entire width of the refrigerator.

2. The refrigerator according to claim 1, further comprising the refrigerating compartment having a door supported on one side thereof; and a container provided therein to store vegetables or other groceries.

3. The refrigerator according to claim 1, wherein a machine space with a compressor therein, a cooling device generating cooled air to be circulated in the refrigerator, a fan for circulating the cooled air, and a cooled air supply controller for distributing the cooled air are provided a lower position than the refrigerating compartment, and wherein a cooled air supply path for the refrigerating compartment is provided at a higher position than the refrigerating compartment.

4. The refrigerator according to claim 1, wherein the cooled air supply controller has at least two cooled air outlets provided therein in front and rear directions with respect to the refrigerator.

5. The refrigerator according to claim 1, further comprising a first partition provided between the refrigerating compartment and the new temperature zone of freezer compartment or the switchable compartment and having a heat insulating material therein; a second partition provided between the new temperature zone of freezer compartment or the switchable compartment and the freezer compartment and having a heat insulating material therein; the machine space provided at a lower rear position in the refrigerator; the cooling device provided behind the freezer compartment; the fan provided behind the new temperature zone of freezer compartment or the switchable compartment; and the cooled air supply controller provided beside the fan; wherein the machine space, the cooling device, the fan and the cooled air supply controller are provided under the first partition.

6. The refrigerator according to claim 4, wherein the cooled air supply controller has a rear cooled air outlet connected to a cooled air supply path for the refrigerating compartment.

7. The refrigerator according to claim 4, further comprising a cooled air supply path extending from a cooled air outlet of the cooled air supply controller to the new temperature zone of freezer compartment or the switchable compartment; a partition provided between the refrigerating compartment and the new temperature zone of freezer compartment or the switchable compartment, and having a heat insulating material therein, the partition having the cooled air supply path formed therein; and a heat insulating material provided between the cooled air supply path and the new temperature zone of freezer compartment or the switchable compartment.

8. The refrigerator according to claim 1, further comprising a container provided at a lower position in the refrigerating compartment to store foods in a temperature zone different from portions the refrigerating compartment except for the container; and a container provided in the new temperature zone of freezer compartment or the switchable compartment; wherein the container in the refrigerating compartment is slidable in front and rear directions with respect to the refrigerator; and the container in the refrigerating compartment has a rear wall located at a position backwardly of a position of a rear wall of the container in the new temperature zone of freezer compartment or the switchable compartment.

9. The refrigerator according to claim 1, further comprising a cooling device; wherein cooled air returned from the refrigerating compartment is sucked into the cooling device at a position in the vicinity of a central portion of the cooling device with respect to a longitudinal axis of the cooling device, and cooled air returned from the freezer compartment is sucked into the cooling device at a position farther from the central portion than the sucked position of the cooled air returned from the refrigerating compartment with respect to a longitudinal axis of the cooling device.

10. The refrigerator according to claim 9, wherein cooled air returned from the new temperature zone of freezer compartment or the switchable compartment is sucked into the cooling device at a position in the vicinity of the central portion.

11. The refrigerator according to claim 1, further comprising:

at least one of the compartments having a door supported on one side thereof, and having a container having a temperature zone different from portions in the at least one compartment except for the container; and a temperature sensor and a cooled air supply controller, both of which independently control a temperature in the container;

wherein the temperature in the container is switchable to at least one of the new temperature zone, the freezing temperature zone, the ice forming temperature zone, the refrigerating temperature zone, the vegetable compartment temperature zone and the wine preserving temperature zone.

12. The refrigerator according to claim 11, wherein the container has a heat insulating material provided therearound.

13. The refrigerator according to claim 11, further comprising a shelf working as a top wall for the container and the container having a front end; the shelf and the front end having heat insulating materials provided thereon.

14. The refrigerator according to claim 8, further comprising a partition surface forming a bottom surface of the refrigerating compartment under the container; an inlet for a cooled air return path for the refrigerating compartment, provided in the partition surface; and a slide rail for the container provided on the partition surface; wherein the inlet is formed at a position in the partition surface except for the slide rail or its extension.

15. The refrigerator according to claim 8, wherein the refrigerating compartment has a temperature therein switchable to an ice forming temperature.

16. The refrigerator according to claim 1, wherein the new temperature zone of freezer compartment or the switchable compartment has a container, which is mounted to a drawable door movable with respect to the refrigerator.

17. The refrigerator according to claim 1, further comprising a lamp cover provided in the refrigerating compartment, the lamp cover having at least one cooled air inlet into the lamp cover and at least one cooled air outlet from the lamp cover.

* * * * *